US011049451B2

(12) United States Patent
Park et al.

(10) Patent No.: US 11,049,451 B2
(45) Date of Patent: Jun. 29, 2021

(54) DISPLAY DEVICE PERFORMING MULTI-FREQUENCY DRIVING

(71) Applicant: Samsung Display Co., Ltd., Yongin-si (KR)

(72) Inventors: Sehyuk Park, Seongnam-si (KR); Sangan Kwon, Cheonan-si (KR); HongSoo Kim, Hwaseong-si (KR); Jinyoung Roh, Hwaseong-si (KR); Hyojin Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/888,284

(22) Filed: May 29, 2020

(65) Prior Publication Data

US 2021/0027707 A1 Jan. 28, 2021

(30) Foreign Application Priority Data

Jul. 26, 2019 (KR) ..... 10-2019-0090840

(51) Int. Cl.
*G09G 3/32* (2016.01)
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0809* (2013.01);
(Continued)

(58) Field of Classification Search
CPC ... G09G 2300/0809; G09G 2310/0289; G09G 2330/021; G09G 2380/02; G09G 3/3233; G09G 3/3266
(Continued)

(56) References Cited

U.S. PATENT DOCUMENTS 8,154,498 B2 * 4/2012 Katayama ..... G09G 3/3688 345/100
2002/0041281 A1 * 4/2002 Yanagi ..... G09G 3/3648 345/212
(Continued)

FOREIGN PATENT DOCUMENTS

KR 10-1354359 B1 1/2014
KR 10-2016-0070445 A 6/2016
(Continued)

*Primary Examiner* — Tony O Davis
(74) *Attorney, Agent, or Firm* — Lewis Roca Rothgerber Christie LLP

(57) ABSTRACT

A display device including: a controller including: a zone splitting block configured to divide input image data into a plurality of partial image data respectively corresponding to a plurality of partial panel zones of the display panel; a plurality of panel zone frequency deciding blocks configured to determine a plurality of driving frequencies for the plurality of partial panel zones by analyzing the plurality of partial image data, respectively; a non-driving period setting block configured to classify a plurality of frame periods into a driving frame period and a non-driving frame period based on a maximum driving frequency of the plurality of driving frequencies; and a scan driver control block configured to provide the scan driver input signal to the scan driver in the driving frame period, and to not provide the scan driver input signal to the scan driver in the non-driving frame period.

18 Claims, 23 Drawing Sheets

(52) U.S. Cl.
CPC ..... *G09G 2310/0289* (2013.01); *G09G 2330/021* (2013.01); *G09G 2380/02* (2013.01)

(58) Field of Classification Search
USPC ..... 345/87, 100–103, 204, 212
See application file for complete search history.

(56) References Cited

U.S. PATENT DOCUMENTS

2002/0186191 A1* 12/2002 Ikeda ..... G09G 3/3648 345/87
2002/0196241 A1* 12/2002 Morita ..... G09G 3/3677 345/204
2003/0122773 A1* 7/2003 Washio ..... G09G 3/3688 345/103
2014/0152553 A1* 6/2014 Cha ..... G06F 3/0481 345/156
2014/0320479 A1* 10/2014 Kaneko ..... G02F 1/13306 345/212
2014/0354882 A1* 12/2014 Fan ..... H04N 19/146 348/441
2015/0256749 A1* 9/2015 Frey ..... H04N 5/77 348/220.1
2018/0233174 A1* 8/2018 Nakagawa ..... G11B 27/34
2018/0286019 A1* 10/2018 Davis ..... G06T 5/50
2019/0237021 A1* 8/2019 Peng ..... G06F 3/14
2019/0287472 A1* 9/2019 Yang ..... G09G 3/3618
2019/0332897 A1* 10/2019 Chen ..... G06K 9/00771
2020/0304809 A1* 9/2020 Komiya ..... H04N 19/172
2020/0320908 A1* 10/2020 Kim ..... G09G 3/3225

FOREIGN PATENT DOCUMENTS

KR 10-1817597 B1 1/2018
KR 10-1962860 B1 3/2019
KR 10-2019-0058995 A 5/2019
KR 10-2020-0034086 A 3/2020
WO WO 2020/060008 A1 3/2020

* cited by examiner

FIG. 5

| GRAY LEVEL | FLICKER VALUE | FREQUENCY(Hz) |
|---|---|---|
| 0-3 | 0 | 1 |
| 4-7 | 0 | 1 |
| 8-11 | 40 | 2 |
| 12-15 | 80 | 5 |
| 16-19 | 120 | 10 |
| 20-23 | 160 | 30 |
| 24-27 | 200 | 60 |
| ⋮ | ⋮ | ⋮ |
| 236-239 | 0 | 1 |
| 240-243 | 0 | 1 |
| 244-247 | 0 | 1 |
| 248-251 | 0 | 1 |
| 252-255 | 0 | 1 |

DISPLAY DEVICE PERFORMING MULTI-FREQUENCY DRIVING

CROSS-REFERENCE TO RELATED APPLICATION

The present application claims priority to and the benefit of Korean Patent Application No. 10-2019-0090840, filed on Jul. 26, 2019 in the Korean Intellectual Property Office (KIPO), the entire content of which is incorporated herein in its entirety by reference.

BACKGROUND

1. Field

Aspects of some example embodiments of the present inventive concept relate to a display device.

2. Description of the Related Art

Efficient or low power consumption is generally desirable in a display device employed in a portable device, such as a smartphone, a tablet computer, etc. For example, in order to reduce the power consumption of display devices, a low frequency driving technique, which drives or refreshes a display panel at a frequency lower than an input frame frequency of input image data, may be utilized.

However, in a related-art display device to which the low frequency driving technique is applied, when a still image is not displayed in an entire region of a display panel, or when the still image is displayed only in a partial region of the display panel, the entire region of the display panel may be driven at a driving frequency substantially the same as the input frame frequency. Thus, in this case, the low frequency driving may not be performed, and the power consumption may not be reduced.

The above information disclosed in this Background section is only for enhancement of understanding of the background and therefore the information discussed in this Background section does not necessarily constitute prior art.

SUMMARY

Aspects of some example embodiments of the present inventive concept relate to a display device, and for example, to a display device that performs multi-frequency driving (MFD).

Some example embodiments include a display device capable of reducing power consumption by performing multi-frequency driving (MFD).

According to some example embodiments, a display device includes: a display panel including a plurality of pixels, a data driver configured to provide data signals to the plurality of pixels, a scan driver configured to provide scan signals to the plurality of pixels based on a scan driver input signal, and a controller configured to control the data driver and the scan driver. The controller includes a zone splitting block configured to divide input image data into a plurality of partial image data respectively corresponding to a plurality of partial panel zones of the display panel, a plurality of panel zone frequency deciding blocks configured to determine a plurality of driving frequencies for the plurality of partial panel zones by analyzing the plurality of partial image data, respectively, a non-driving period setting block configured to classify a plurality of frame periods into a driving frame period and a non-driving frame period based on a maximum driving frequency of the plurality of driving frequencies, and a scan driver control block configured to provide the scan driver input signal to the scan driver in the driving frame period, and not to provide the scan driver input signal to the scan driver in the non-driving frame period.

According to some example embodiments, the scan driver control block may not provide, as the scan driver input signal, a scan start signal and a scan clock signal to the scan driver in the non-driving frame period.

According to some example embodiments, the controller may further include a power block configured to generate a high gate voltage and a low gate voltage. The scan driver control block may include a scan driver input signal generating unit configured to generate an initial scan start signal and an initial scan clock signal, and a level shifting unit configured to generate, as the scan driver input signal, a scan start signal and a scan clock signal by changing voltage levels of the initial scan start signal and the initial scan clock signal based on at least one of the high gate voltage and the low gate voltage. In the non-driving frame period, the power block may change the at least one of the high gate voltage and the low gate voltage to an off level.

According to some example embodiments, the scan driver control block may provide a scan output masking signal to the scan driver in a partial period of the driving frame period assigned to a portion of the plurality of partial panel zones such that the scan signals are not provided to the portion of the plurality of partial panel zones within the driving frame period.

According to some example embodiments, the scan driver may include a plurality of stages configured to generate the scan signals for a plurality of scan lines included in the display panel, and a plurality of logic gates respectively connected to the plurality of stages, and configured to selectively output the scan signals generated by the plurality of stages in response to the scan output masking signal, respectively.

According to some example embodiments, the display device may be a foldable display device. The plurality of partial panel zones may include a first partial panel zone located in a first direction from a folding line of the foldable display device, and a second partial panel zone located in a second direction opposite to the first direction from the folding line. The zone splitting block may divide the input image data into, as the plurality of partial image data, first partial image data for the first partial panel zone and second partial image data for the second partial panel zone.

According to some example embodiments, each of the plurality of panel zone frequency deciding blocks may include a still image detecting unit configured to receive corresponding partial image data of the plurality of partial image data at an input frame frequency, and to determine whether the corresponding partial image data represent a still image, and a driving frequency deciding unit configured to determine a corresponding driving frequency of the plurality of driving frequencies as the input frame frequency when the corresponding partial image data do not represent the still image, and to determine the corresponding driving frequency as a frequency lower than the input frame frequency when the corresponding partial image data represent the still image.

According to some example embodiments, each of the plurality of panel zone frequency deciding blocks may further include a representative value memory configured to store a representative value of the corresponding partial image data in a previous frame period. The still image detecting unit may calculate a representative value of the corresponding partial image data in a current frame period, and may determine whether the corresponding partial image data represent the still image by comparing the calculated representative value of the corresponding partial image data with the representative value of the corresponding partial image data stored in the representative value memory.

According to some example embodiments, each of the plurality of panel zone frequency deciding blocks may further include a flicker lookup table configured to store flicker values corresponding to respective image data gray levels. When the corresponding partial image data represent the still image, the driving frequency deciding unit may determines a flicker value corresponding to a gray level of the corresponding partial image data by using the flicker lookup table, and may determine the corresponding driving frequency according to the determined flicker value.

According to some example embodiments, each of the plurality of panel zone frequency deciding blocks may further include a driving frequency mixing unit configured to gradually change a corresponding one of the plurality of driving frequencies for a corresponding partial panel zone of the plurality of partial panel zones from a previous driving frequency for the partial panel zone to the corresponding driving frequency determined by the driving frequency deciding unit when the corresponding driving frequency determined by the driving frequency deciding unit is changed from the previous driving frequency.

According to some example embodiments, each of the plurality of pixels may include a driving transistor configured to generate a driving current, a switching transistor configured to transfer a corresponding one of the data signals to a source of the driving transistor, a compensating transistor configured to diode-connect the driving transistor, a storage capacitor configured to store the corresponding one of the data signals transferred through the switching transistor and the diode-connected driving transistor, a first initializing transistor configured to provide an initialization voltage to the storage capacitor and a gate of the driving transistor, a first emission controlling transistor configured to connect a line of a power supply voltage to the source of the driving transistor, a second emission controlling transistor configured to connect a drain of the driving transistor to an organic light emitting diode, a second initializing transistor configured to provide the initialization voltage to the organic light emitting diode, and the organic light emitting diode configured to emit light based on the driving current. At least first one of the driving transistor, the switching transistor, the compensating transistor, the first initializing transistor, the first emission controlling transistor, the second emission controlling transistor and the second initializing transistor may be implemented with a PMOS transistor, and at least second one of the driving transistor, the switching transistor, the compensating transistor, the first initializing transistor, the first emission controlling transistor, the second emission controlling transistor and the second initializing transistor may be implemented with an NMOS transistor.

According to some example embodiments, the non-driving period setting block may set a partial period of the driving frame period as a non-driving partial frame period based on a driving frequency lower than the maximum driving frequency among the plurality of driving frequencies, and the scan driver control block may not provide the scan driver input signal to the scan driver in the non-driving frame period and the non-driving partial frame period.

According to some example embodiments, the controller may further include a power block configured to generate a high gate voltage and a low gate voltage. The scan driver control block may include a scan driver input signal generating unit configured to generate an initial scan start signal and an initial scan clock signal, and a level shifting unit configured to generate, as the scan driver input signal, a scan start signal and a scan clock signal by changing voltage levels of the initial scan start signal and the initial scan clock signal based on at least one of the high gate voltage and the low gate voltage. In the non-driving frame period and the non-driving partial frame period, the power block may change the at least one of the high gate voltage and the low gate voltage to an off level.

According to some example embodiments, a display device includes: a display panel including a plurality of pixels, a data driver configured to provide data signals to the plurality of pixels, a scan driver configured to provide scan signals to the plurality of pixels based on a scan driver input signal, and a controller configured to control the data driver and the scan driver. The controller includes a zone splitting and still image detecting block configured to receive input image data at an input frame frequency, and configured to divide the input image data into moving image partial data representing a moving image and still image partial data representing a still image, a zone splitting and panel zone frequency deciding block configured to determine a first driving frequency for a first partial panel zone of the display panel corresponding to the moving image partial data as the input frame frequency, and to determine a plurality of second driving frequencies for a plurality of second partial panel zones of the display panel by analyzing the still image partial data, a non-driving period setting block configured to classify a plurality of frame periods into a driving frame period and a non-driving frame period based on a maximum driving frequency of the first driving frequency and the plurality of second driving frequencies, and a scan driver control block configured to provide the scan driver input signal to the scan driver in the driving frame period, and not to provide the scan driver input signal to the scan driver in the non-driving frame period.

According to some example embodiments, the scan driver control block may not provide, as the scan driver input signal, a scan start signal and a scan clock signal to the scan driver in the non-driving frame period.

According to some example embodiments, the controller may further include a power block configured to generate a high gate voltage and a low gate voltage. The scan driver control block may include a scan driver input signal generating unit configured to generate an initial scan start signal and an initial scan clock signal, and a level shifting unit configured to generate, as the scan driver input signal, a scan start signal and a scan clock signal by changing voltage levels of the initial scan start signal and the initial scan clock signal based on at least one of the high gate voltage and the low gate voltage. In the non-driving frame period, the power block may change the at least one of the high gate voltage and the low gate voltage to an off level.

According to some example embodiments, the zone splitting and still image detecting block may include a plurality of representative value memories configured to store a plurality of representative values of a plurality of input partial image data in a previous frame period, and a zone still image detecting unit configured to receive the input image data in a current frame period, to divide the input image data in the current frame period into the plurality of input partial image data, to calculate a plurality of representative values of the plurality of input partial image data in the current frame period, to determine whether each of the plurality of input partial image data represent the moving image or the still image by comparing the plurality of calculated representative values with the plurality of representative values stored in the plurality of representative value memories, to output input partial image data representing the moving image among the plurality of input partial image data as the moving image partial data, and to output input partial image data representing the still image among the plurality of input partial image data as the still image partial data.

According to some example embodiments, the zone splitting and panel zone frequency deciding block may include a flicker lookup table configured to store flicker values corresponding to respective image data gray levels, and a zone driving frequency deciding unit configured to determine the first driving frequency for the first partial panel zone corresponding to the moving image partial data as the input frame frequency, to divide the still image partial data into a plurality of segment data for a plurality of segments, to determine a plurality of segment flicker values corresponding to gray levels of the plurality of segment data by using the flicker lookup table, to determine the plurality of second partial panel zones by grouping the plurality of segments based on a plurality of segment driving frequencies corresponding to the plurality of segment flicker values, and to respectively determine the plurality of second driving frequencies for the plurality of second partial panel zones based on the plurality of segment driving frequencies of the plurality of second partial panel zones.

According to some example embodiments, the non-driving period setting block may set a partial period of the driving frame period as a non-driving partial frame period based on a driving frequency lower than the maximum driving frequency among the first driving frequency and the plurality of second driving frequencies, and the scan driver control block may not provide the scan driver input signal to the scan driver in the non-driving frame period and the non-driving partial frame period.

According to some example embodiments, the controller further may include a power block configured to generate a high gate voltage and a low gate voltage. The scan driver control block may include a scan driver input signal generating unit configured to generate an initial scan start signal and an initial scan clock signal, and a level shifting unit configured to generate, as the scan driver input signal, a scan start signal and a scan clock signal by changing voltage levels of the initial scan start signal and the initial scan clock signal based on at least one of the high gate voltage and the low gate voltage. In the non-driving frame period and the non-driving partial frame period, the power block may change the at least one of the high gate voltage and the low gate voltage to an off level.

As described above, a display device according to some example embodiments may set a non-driving frame period based on the maximum driving frequency of a plurality of driving frequencies for a plurality of partial panel zones, and may not provide a scan driver input signal to a scan driver in the non-driving frame period. Accordingly, the display device according to some example embodiments can further reduce the power consumption when performing the multi-frequency driving (MFD).

BRIEF DESCRIPTION OF THE DRAWINGS

Illustrative, non-limiting example embodiments will be more clearly understood from the following detailed description in conjunction with the accompanying drawings.

FIG. 5 is a diagram illustrating an example of a flicker lookup table (LUT) illustrated in FIG. 4.

DETAILED DESCRIPTION

Hereinafter, aspects of some example embodiments of the present inventive concept will be explained in more detail with reference to the accompanying drawings.

Figure 1:
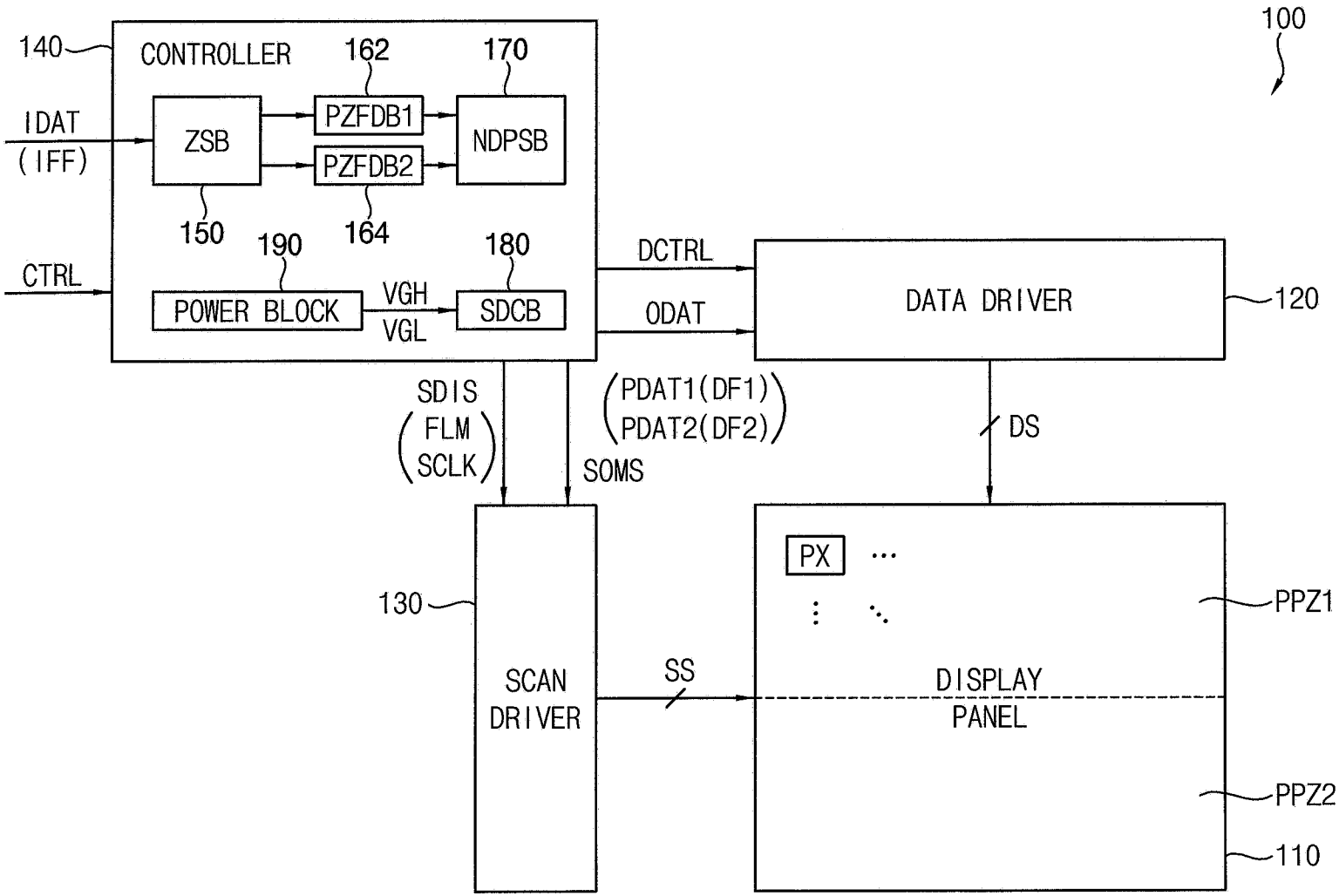
FIG. 1 is a block diagram illustrating a display device according to some example embodiments.
Figure 2:
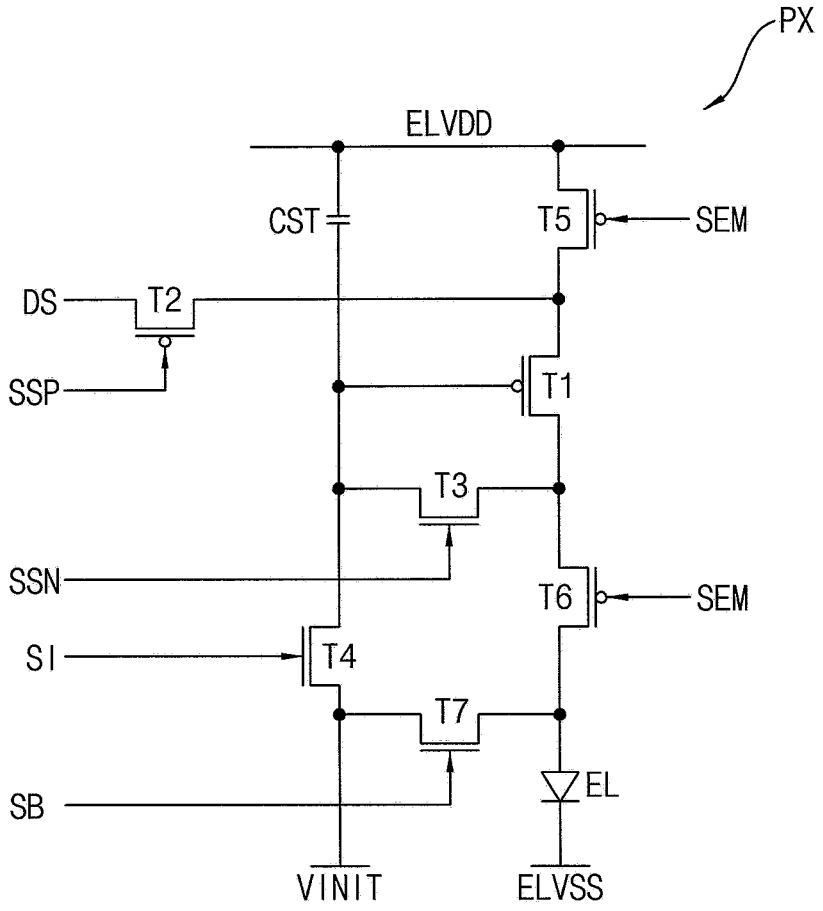
FIG. 2 is a circuit diagram illustrating an example of a pixel included in a display device according to some example embodiments.
Figure 3A:
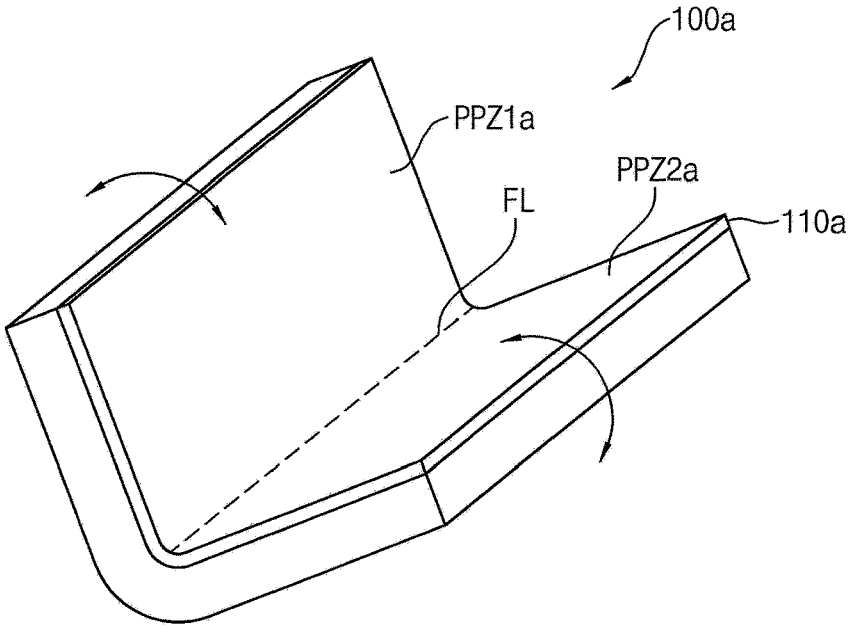
FIG. 3A is a diagram illustrating an example where a display device of FIG. 1 is an in-folding display device.
Figure 3B:
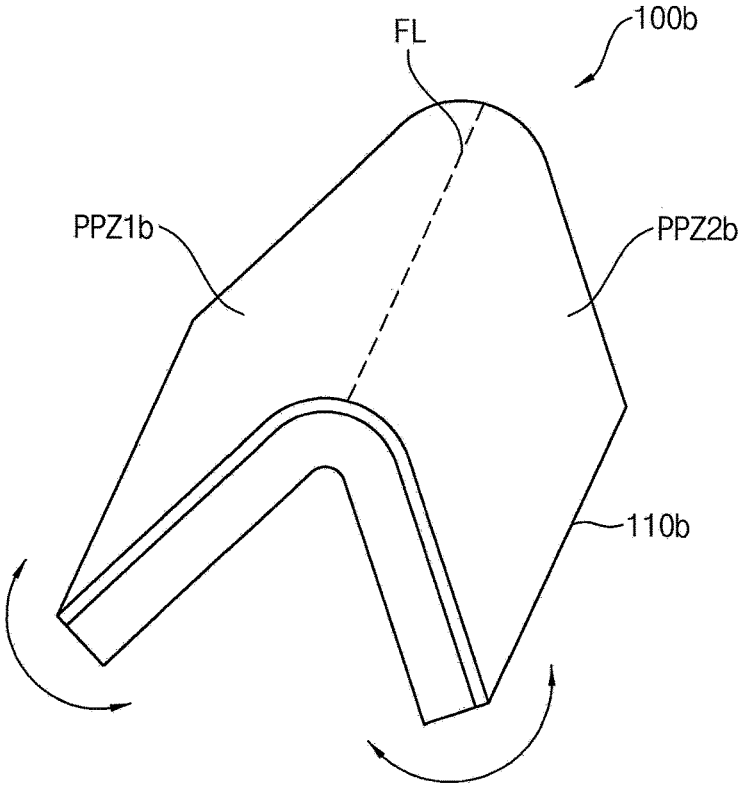
FIG. 3B is a diagram illustrating an example where a display device of FIG. 1 is an out-folding display device.
Figure 4:
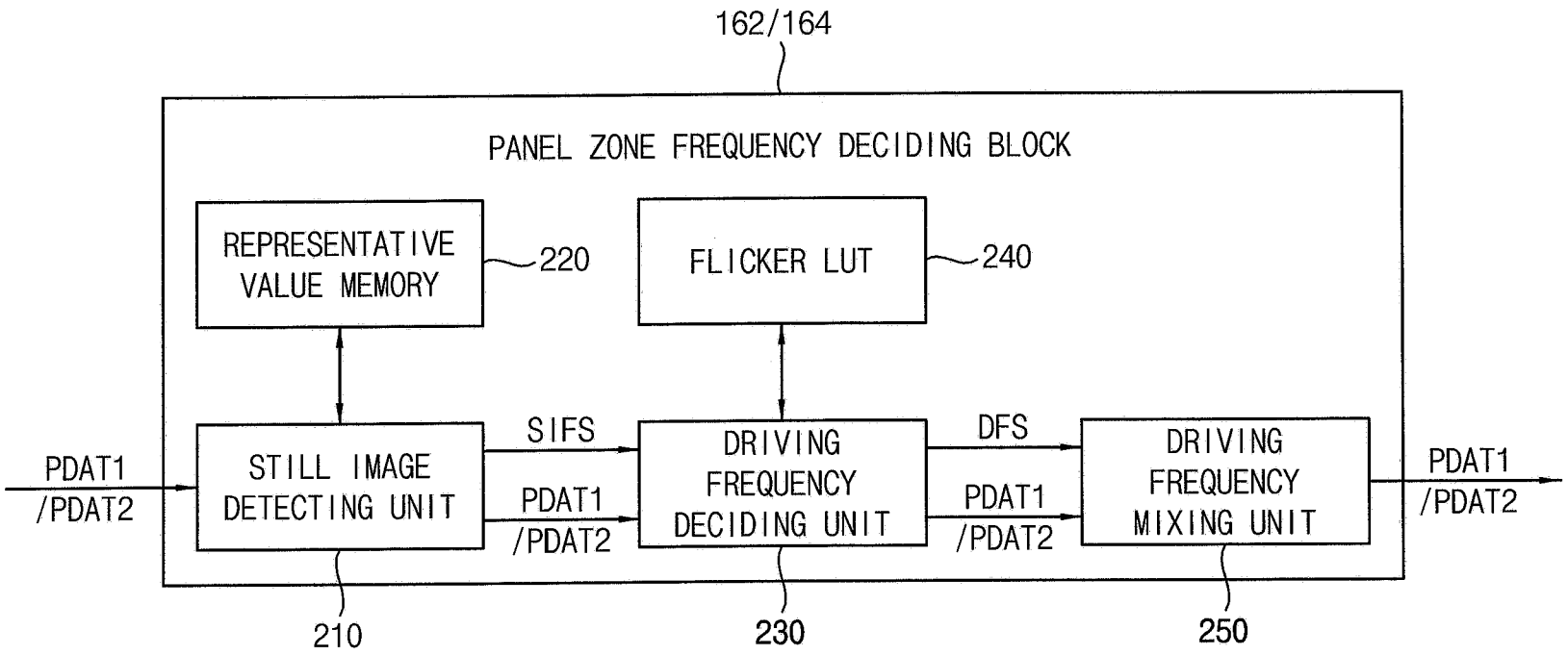
FIG. 4 is a block diagram illustrating an example of each panel zone frequency deciding block included in a display device according to some example embodiments.
Figure 6:
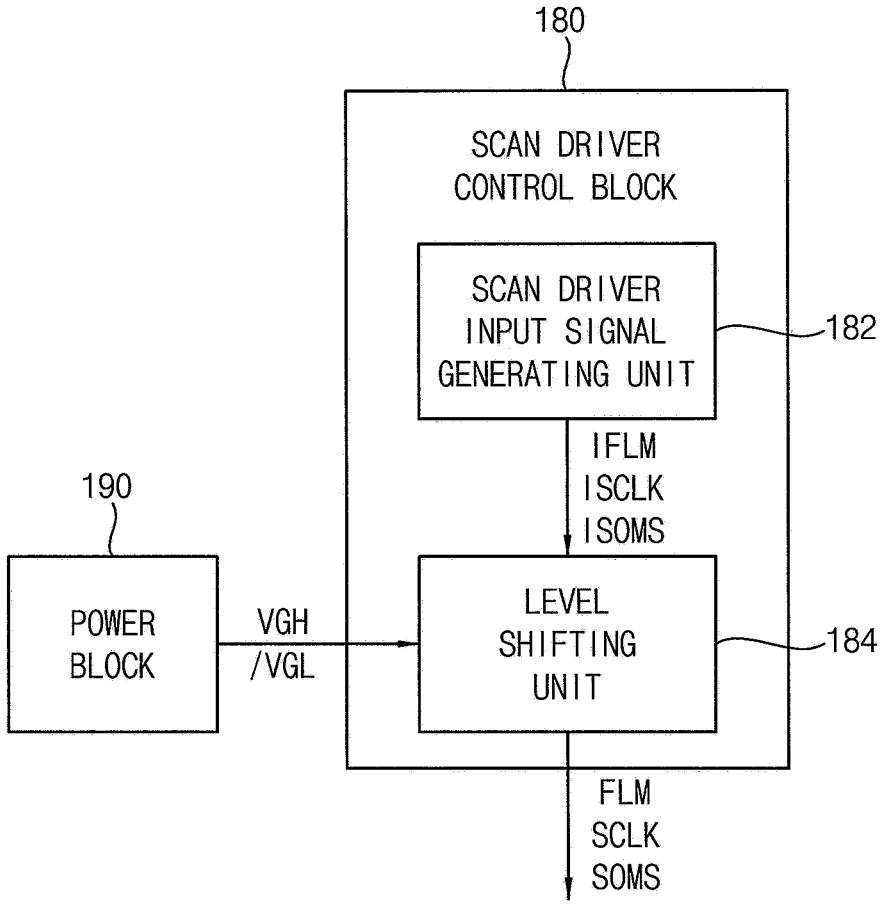
FIG. 6 is a block diagram illustrating an example of a scan driver control block included in a display device according to some example embodiments.
Figure 7:
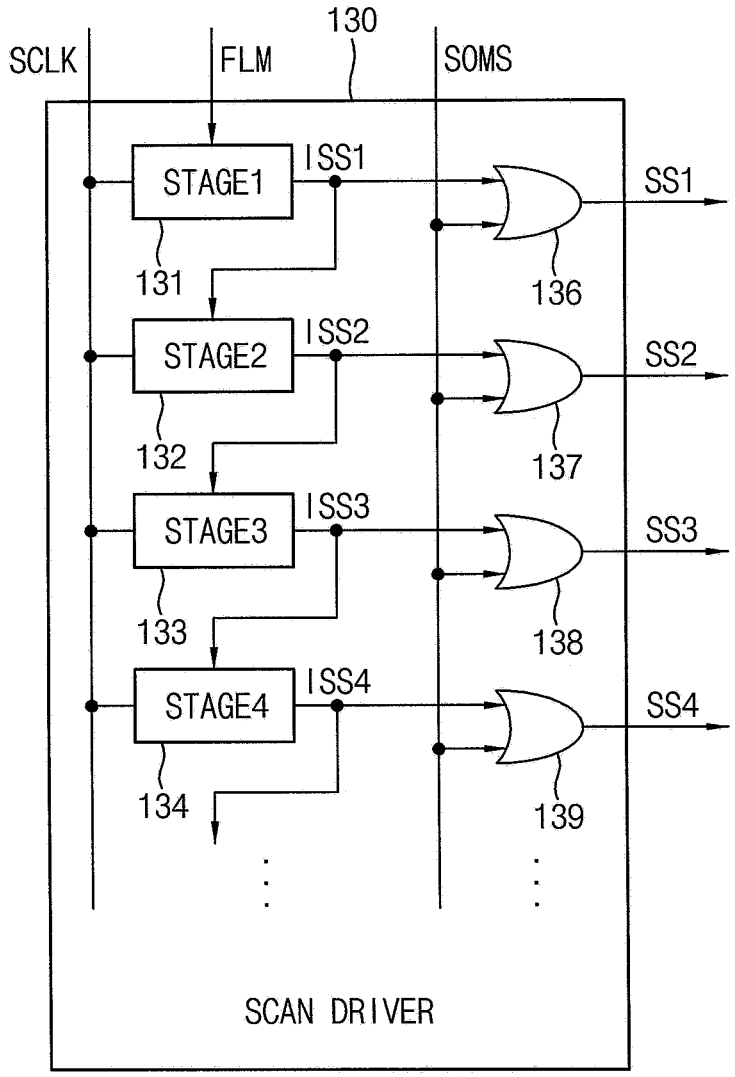
FIG. 7 is a block diagram illustrating an example of a scan driver included in a display device according to some example embodiments.
Figure 8:
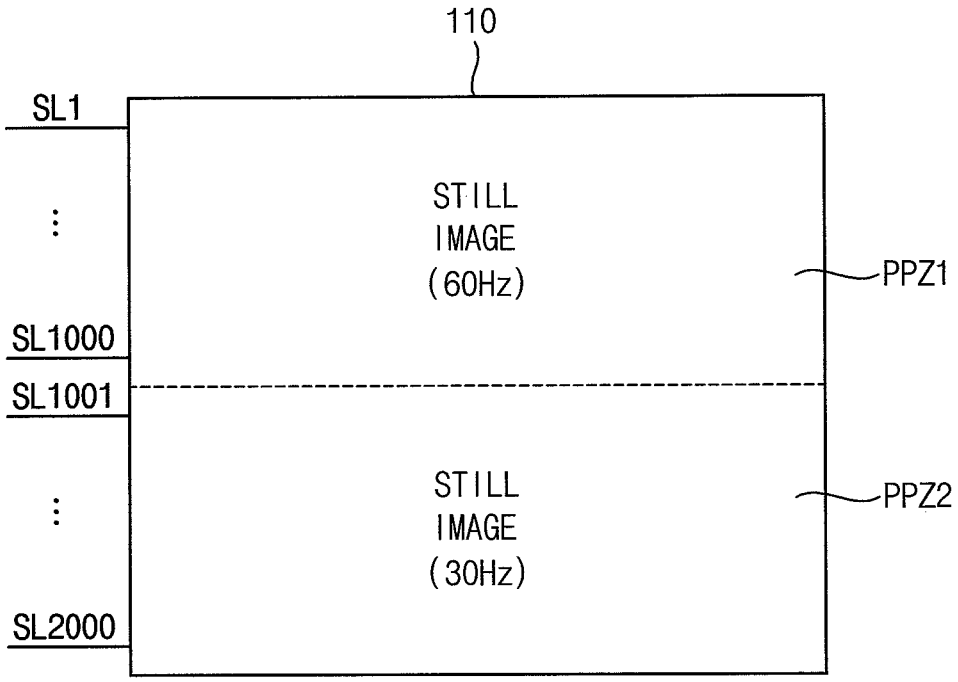
FIG. 8 is a diagram for describing an example of first and second driving frequencies determined for first and second partial panel zones of a display panel.
Figure 9:
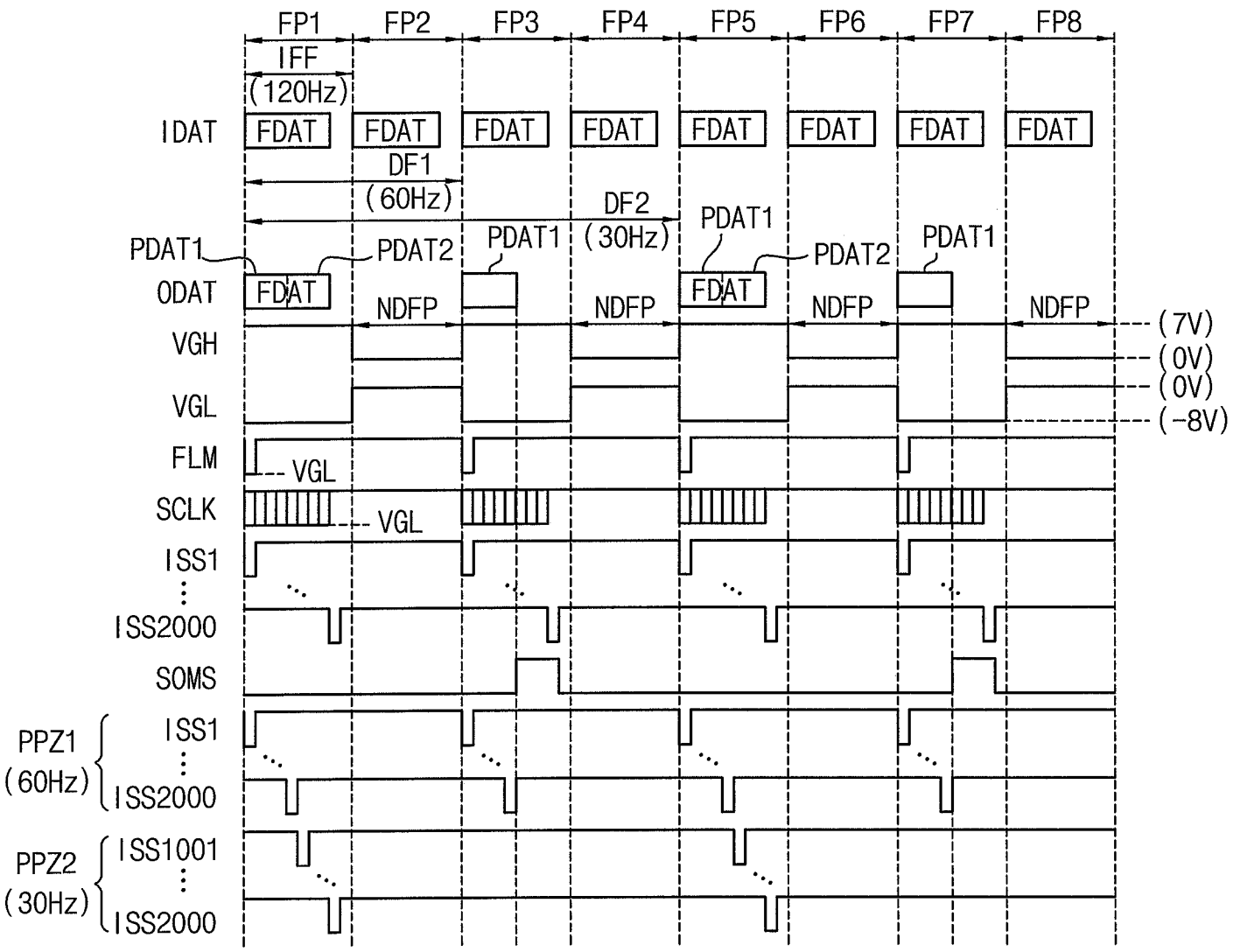
FIG. 9 is a timing diagram for describing an example of an operation of a display device according to some example embodiments.

FIG. 1 is a block diagram illustrating a display device according to some example embodiments, FIG. 2 is a circuit diagram illustrating an example of a pixel included in a display device according to some example embodiments, FIG. 3A is a diagram illustrating an example where a display device of FIG. 1 is an in-folding display device, FIG. 3B is a diagram illustrating an example where a display device of FIG. 1 is an out-folding display device, FIG. 4 is a block diagram illustrating an example of each panel zone frequency deciding block included in a display device according to some example embodiments, FIG. 5 is a diagram illustrating an example of a flicker lookup table (LUT) illustrated in FIG. 4, FIG. 6 is a block diagram illustrating an example of a scan driver control block included in a display device according to some example embodiments, FIG. 7 is a block diagram illustrating an example of a scan driver included in a display device according to some example embodiments, FIG. 8 is a diagram for describing an example of first and second driving frequencies determined for first and second partial panel zones of a display panel, and FIG. 9 is a timing diagram for describing an example of an operation of a display device according to some example embodiments.

Referring to FIG. 1, a display device 100 according to some example embodiments may include a display panel 110 including a plurality of pixels PX, a data driver 120 providing data signals DS to the plurality of pixels PX, a scan driver 130 providing scan signals SS to the plurality of pixels PX based on a scan driver input signal SDIS, and a controller 140 controlling the data driver 120 and the scan driver 130.

The display panel 110 may include a plurality of data lines, a plurality of scan lines, and the plurality of pixels PX connected to the plurality of data lines and the plurality of scan lines. In some example embodiments, each pixel PX may include at least one capacitor, at least two transistors and an organic light emitting diode (OLED), and the display panel 110 may be an OLED display panel. Further, in some example embodiments, each pixel PX may be a hybrid oxide polycrystalline (HOP) pixel suitable for low frequency driving capable of reducing power consumption. In the HOP pixel, at least one first transistor may be implemented with a low-temperature polycrystalline silicon (LTPS) PMOS transistor, and at least one second transistor may be implemented with an oxide NMOS transistor.

For example, as illustrated in FIG. 2, each pixel PX may include a driving transistor T1 that generates a driving current, a switching transistor T2 that transfers the data signal DS from the data driver 120 to a source of the driving transistor T1 in response to a first scan signal SSP from the scan driver 130, a compensating transistor T3 that diode-connects the driving transistor T1 in response to a second scan signal SSN from the scan driver 130, a storage capacitor CST that stores the data signal DS transferred through the switching transistor T2 and the diode-connected driving transistor T1, a first initializing transistor T4 that provides an initialization voltage VINIT to the storage capacitor CST and a gate of the driving transistor T1 in response to a first initialization signal SI from the scan driver 130, a first emission controlling transistor T5 that connects a line of a high power supply voltage ELVDD to the source of the driving transistor T1 in response to an emission control signal SEM from an emission driver, a second emission controlling transistor T6 that connects a drain of the driving transistor T1 to an organic light emitting diode EL in response to the emission control signal SEM from the emission driver, a second initializing transistor (or a bypass transistor) T7 that provides the initialization voltage VINIT to the organic light emitting diode EL in response to a second initialization signal (or a bypass signal) SB from the scan driver 130, and the organic light emitting diode EL that emits light based on the driving current from the line of the high power supply voltage ELVDD to a line of a low power supply voltage ELVSS.

At least first one of the driving transistor T1, the switching transistor T2, the compensating transistor T3, the first initializing transistor T4, the first emission controlling transistor T5, the second emission controlling transistor T6 and the second initializing transistor T7 may be implemented with a PMOS transistor, and at least second one of the driving transistor T1, the switching transistor T2, the compensating transistor T3, the first initializing transistor T4, the first emission controlling transistor T5, the second emission controlling transistor T6 and the second initializing transistor T7 may be implemented with an NMOS transistor. For example, as illustrated in FIG. 2, the compensating transistor T3, the first initializing transistor T4 and the second initializing transistor T7 may be implemented with the NMOS transistors, and other transistors T1, T2, T5 and T6 may be implemented with the PMOS transistors. In this case, the second scan signal SSN applied to the compensating transistor T3, the first initialization signal SI applied to the first initializing transistor T4 and the second initialization signal SB applied to the second initializing transistor T7 may be active-high signals suitable for the NMOS transistor. In this case, because the transistors T3 and T4 directly connected to the storage capacitor CST and the transistor T7 directly connected to the organic light emitting diode EL are implemented with the NMOS transistors, leakage currents from the storage capacitor CST and/or a parasitic capacitor of the organic light emitting diode EL may be reduced, and thus the pixel PX may be suitable for the low frequency driving. Although FIG. 2 illustrates an example where the compensating transistor T3, the first initializing transistor T4 and the second initializing transistor T7 are implemented with the NMOS transistors, a configuration of each pixel PX according to some example embodiments is not limited to the example of FIG. 2. In other example embodiments, the display panel 110 may be a liquid crystal display (LCD) panel, or the like.

The data driver 120 may generate the data signals DS based on output image data ODAT and a data control signal DCTRL received from the controller 140, and may provide the data signals DS to the plurality of pixels PX through the plurality of data lines. In some example embodiments, the data control signal DCTRL may include, but not be limited to, an output data enable signal, a horizontal start signal and a load signal. In some example embodiments, the data driver 120 and the controller 140 may be implemented with a single integrated circuit, and the integrated circuit may be referred to as a timing controller embedded data driver (TED). In other example embodiments, the data driver 120 and the controller 140 may be implemented with separate integrated circuits.

The scan driver 130 may provide the scan signals SS to the plurality of pixels PX through the plurality of scan lines based on a scan driver input signal SDIS received from the controller 140. In some example embodiments, the scan driver 130 may sequentially provide the scan signals SS to the plurality of pixels PX on a row-by-row basis. Further, in some example embodiments, the scan driver input signal SDIS may include, but not be limited to, a scan start signal FLM and a scan clock signal SCLK. In some example embodiments, the scan driver 130 may further receive a scan output masking signal SOMS from the controller 140. In some example embodiments, the scan driver 130 may be integrated or formed in a peripheral portion of the display panel 110. In other example embodiments, the scan driver 130 may be implemented with one or more integrated circuits.

The controller (e.g., a timing controller (TCON)) 140 may receive input image data IDAT and a control signal CTRL from an external host (e.g., a graphic processing unit (GPU) or a graphic card). In some example embodiments, the control signal CTRL may include, but not be limited to, a vertical synchronization signal, a horizontal synchronization signal, an input data enable signal, a master clock signal, etc. The controller 140 may generate the output image data ODAT, the data control signal DCTRL and the scan driver input signal SDIS based on the input image data IDAT and the control signal CTRL. The controller 140 may control an operation of the data driver 120 by providing the output image data ODAT and the data control signal DCTRL to the data driver 120, and may control an operation of the scan driver 130 by providing the scan driver input signal SDIS to the scan driver 130.

The display device 100 according to some example embodiments may perform multi-frequency driving (MFD) that drives a plurality of partial panel zones (or regions) PPZ1 and PPZ2 of the display panel 110 at a plurality of different driving frequencies DF1 and DF2. To reduce the power consumption, the display device 100 according to some example embodiments may set a non-driving frame period based on the maximum driving frequency of the plurality of driving frequencies DF1 and DF2, and may not provide the scan driver input signal SDIS to the scan driver 130 in the non-driving frame period. Here, that the scan driver input signal SDIS is not provided to the scan driver 130 may mean that the scan driver input signal SDIS is not output to the scan driver 130, or that the scan driver input signal SDIS having an off level (e.g., a ground voltage level or a voltage level close to the ground voltage level) is output to the scan driver 130. To perform these operations, in some example embodiments, the controller 140 may include a zone splitting block (ZSB) 150, first and second panel zone frequency deciding blocks (PZFDB1 and PZFDB2) 162 and 164, a non-driving period setting block (NDPSB) 170, a scan driver control block (SDCB) 180 and a power block 190.

The zone splitting block 150 may divide or split the input image data IDAT into first and second partial image data PDAT1 and PDAT2 respectively corresponding to first and second partial panel zones PPZ1 and PPZ2 of the display panel 110. For example, the zone splitting block 150 may divide the input image data IDAT into the first and second partial image data PDAT1 and PDAT2 such that each of the first and second partial panel zones PPZ1 and PPZ2 corresponding to the first and second partial image data PDAT1 and PDAT2 may include one or more scan lines, or one or more pixel rows connected to the one or more scan lines, or such that the display panel 110 may be divided (or split) along a data line direction.

In some example embodiments, the display device 100 may be a foldable display device, and the zone splitting block 150 may divide the input image data IDAT into the first and second partial image data PDAT1 and PDAT2 such that a boundary between the first and second partial panel zones PPZ1 and PPZ2 corresponding to the first and second partial image data PDAT1 and PDAT2 may correspond to a folding line that is a portion in which the foldable display device is folded. In an example, as illustrated in FIG. 3A, the display device 100 may be an in-folding display device 100*a* including an in-folding display panel 110*a* that is folded such that the first and second partial panel zones PPZ1*a* and PPZ2*a* face each other, the first partial panel zone PPZ1*a* may be located in a first direction from the folding line FL of the in-folding display device 100*a*, and the second partial panel zone PPZ2*a* may be located in a second direction opposite to the first direction from the folding line FL of the in-folding display device 100*a*. In another example, as illustrated in FIG. 3B, the display device 100 may be an out-folding display device 100*b* including an out-folding display panel 110*b* that is folded such that one of the first and second partial panel zones PPZ1*b* and PPZ2*b* is located at a front side and the other one of the first and second partial panel zones PPZ1*b* and PPZ2*b* is located at a back side, the first partial panel zone PPZ1*b* may be located in a first direction from the folding line FL of the out-folding display device 100*b*, and the second partial panel zone PPZ2*b* may be located in a second direction opposite to the first direction from the folding line FL of the out-folding display device 100*b*. Although FIGS. 3A and 3B illustrate examples where the display device 100 may be the foldable display devices 100*a* and 100*b*, in some example embodiments, the display device 100 may be any flexible display device, such as a curved display device, a bended display device, a rollable display device, a stretchable display device, etc. In other example embodiments, the display device 100 may be a flat (e.g., rigid) display device.

The zone splitting block 150 may provide the first partial image data PDAT1 for the first partial panel zone PPZ1 to the first panel zone frequency deciding block 162, and may provide the second partial image data PDAT2 for the second partial panel zone PPZ2 to the second panel zone frequency deciding block 164.

The first panel zone frequency deciding block 162 may determine a first driving frequency DF1 for the first partial panel zone PPZ1 by analyzing the first partial image data PDAT1, and the second panel zone frequency deciding block 164 may determine a second driving frequency DF2 for the second partial panel zone PPZ2 by analyzing the second partial image data PDAT2. To perform these operations, as illustrated in FIG. 4, each of the first and second panel zone frequency deciding blocks 162 and 164 may include a still image detecting unit 210 and a driving frequency deciding unit 230. In some example embodiments, each of the first and second panel zone frequency deciding blocks 162 and 164 may further include a representative value memory 220, a flicker lookup table (LUT) 240 and a driving frequency mixing unit 260. The first and second panel zone frequency deciding blocks 162 and 164 may have substantially the same configuration and operation, and thus a configuration and an operation of the first panel zone frequency deciding block 162 will be described below.

The still image detecting unit 210 may receive the partial image data PDAT1 at an input frame frequency IFF, and may determine whether the partial image data PDAT1 represent the still image.

In some example embodiments, the still image detecting unit 210 may determine whether the partial image data PDAT1 represent the still image by comparing the partial image data PDAT1 in a previous frame period and the partial image data PDAT1 in a current frame period by using the representative value memory 220. For example, the representative value memory 220 may store a representative value (e.g., an average value or a checksum) of the partial image data PDAT1 in the previous frame period. The still image detecting unit 210 may calculate a representative value of the partial image data PDAT1 in the current frame period, and may determine whether the partial image data PDAT1 represent the still image by comparing the calculated representative value of the partial image data PDAT1 with the representative value of the partial image data PDAT1 stored in the representative value memory 220. The still image detecting unit 210 may store the calculated representative value of the partial image data PDAT1 in the current frame period in the representative value memory 220 to be used in the next frame period. In some example embodiments, the single representative value memory 220 may be shared by the first and second panel zone frequency deciding blocks 162 and 164, but the number of the representative value memory 220 may not be limited to one.

The still image detecting unit 210 may output the partial image data PDAT1 to the driving frequency deciding unit 230, and may further output a still image flag signal SIFS representing whether the partial image data PDAT1 represent the still image.

The driving frequency deciding unit 230 may determine a driving frequency DF1 for a corresponding partial panel zone (or region) PPZ1 according to whether the partial image data PDAT1 represent the still image. In some example embodiments, the driving frequency deciding unit 230 may determine the driving frequency DF1 for the partial panel zone PPZ1 when the partial image data PDAT1 do not represent the still image (or represent a moving image) as the input frame frequency IFF, and may determine the driving frequency DF1 for the partial panel zone PPZ1 as a frequency lower than the input frame frequency IFF when the partial image data PDAT1 represent the still image.

In some example embodiments, when the partial image data PDAT1 represent the still image, the driving frequency deciding unit 230 may determine a flicker value according to a gray level (or luminance) of the partial image data PDAT1 by using a flicker lookup table (LUT) 240, and may determine the driving frequency DF1 for the partial panel zone PPZ1 according to the flicker value. For example, as illustrated in FIG. 5, the flicker LUT 240 may store flicker values corresponding to respective image data gray levels (e.g., 256 gray levels from 0-gray level to 255-gray level). Here, the flicker value may represent a level of the flicker perceived by a user. In an example, the flicker LUT 240 may store one flicker value per four gray levels as illustrated in FIG. 5, but the number of flicker values stored in the flicker LUT 240 may not be limited to the example of FIG. 5. For example, in a case where the partial image data PDAT1 represent 0-gray level through 7-gray level, the driving frequency deciding unit 230 may determine the flicker value of the partial image data PDAT1 as 0 by using the flicker LUT 240, and may determine the driving frequency DF1 for the partial panel zone PPZ1 as about 1 Hz according to the flicker value of 0. In another example, in a case where the partial image data PDAT1 represent 20-gray level through 23-gray level, the driving frequency deciding unit 230 may determine the flicker value of the partial image data PDAT1 as 160 by using the flicker LUT 240, and may determine the driving frequency DF1 for the partial panel zone PPZ1 as about 30 Hz according to the flicker value of 16. According to some example embodiments, determining the flicker value and the driving frequency may be performed on a pixel-by-pixel basis, a segment-by-segment basis, or a partial panel zone-by-partial panel zone basis. For example, the partial image data PDAT1 may be divided into a plurality of segment data for a plurality of segments, flicker values for the respective segments may be determined, driving frequencies for the respective segments may be determined, and the driving frequency DF1 for the partial panel zone PPZ1 may be determined as the maximum one of the determined driving frequencies for the respective segments. In some example embodiments, the flicker LUT 240 may be shared by the first and second panel zone frequency deciding blocks 162 and 164, but the number of the flicker LUT 240 may not be limited to one.

The driving frequency deciding unit 230 may output the partial image data PDAT1, and may further output a driving frequency signal DFS representing the driving frequency DF1 for the partial panel zone PPZ1.

When the driving frequency DF1 determined by the driving frequency deciding unit 230 is changed from a previous driving frequency DF1, the driving frequency mixing unit 250 may gradually change the driving frequency DF1 from the previous driving frequency DF1 to the newly determined driving frequency DF1. For example, in a case where the previous driving frequency DF1 for the partial panel zone PPZ1 is about 120 Hz, and the newly determined driving frequency DF1 for the partial panel zone PPZ1 is about 15 Hz, the driving frequency mixing unit 250 may gradually change the driving frequency DF1 for the partial panel zone PPZ1 from about 120 Hz, to about 60 Hz, to about 30 Hz and to about 30 Hz for a period of time (e.g., a set or predetermined period of time).

Referring again to FIG. 1, the non-driving period setting block 170 may determine the maximum driving frequency among the first and second driving frequencies DF1 and DF2 for the first and second partial panel zones PPZ1 and PPZ2 determined by the first and second panel zone frequency deciding blocks 162 and 164, and may set a non-driving frame period based on the maximum driving frequency. In some example embodiments, the non-driving period setting block 170 may classify a plurality of frame periods into a driving frame period and the non-driving frame period based on the maximum driving frequency of the first and second driving frequencies DF1 and DF2. For example, in a case where the input frame frequency IFF is about 120 Hz, and the maximum driving frequency of the first and second driving frequencies DF1 and DF2 is about 30 Hz, based on the maximum driving frequency of about 30 Hz, the non-driving period setting block 170 may classify one frame period of four frame periods as the driving frame period, and may classify three frame periods of the four frame periods as the non-driving frame periods.

The scan driver control block 180 may provide the scan driver input signal SDIS to the scan driver 130 in the driving frame period, and may not provide the scan driver input signal SDIS to the scan driver 130 in the non-driving frame period. In some example embodiments, the scan driver input signal SDIS provided from the scan driver control block 180 to the scan driver 130 may include the scan start signal FLM and the scan clock signal SCLK. Thus, the scan driver control block 180 may not provide, as the scan driver input signal SDIS, the scan start signal FLM and the scan clock signal SCLK to the scan driver 130 in the non-driving frame period. In some example embodiments, the scan clock signal SCLK provided from the scan driver control block 180 to the scan driver 130 may include, but not be limited to, a plurality of clock signals having different phases.

In some example embodiments, in order that the scan driver control block 180 may not provide the scan start signal FLM and the scan clock signal SCLK to the scan driver 130 in the non-driving frame period, the controller 140 may control the power block 190 for at least one of a high gate voltage VGH or a low gate voltage VGL not to be output in the non-driving frame period or to have an off level (e.g., a ground voltage level or a voltage level close to the ground voltage level) in the non-driving frame period.

For example, as illustrated in FIG. 6, the scan driver control block 180 may include a scan driver input signal generating unit 182 and a level shifting unit 184. The scan driver input signal generating unit 182 may generate an initial scan start signal IFLM and an initial scan clock signal ISCLK. The power block 190 may provide the high gate voltage VGH and/or the low gate voltage VGL to the level shifting unit 184. In some example embodiments, the power block 190 may provide the high gate voltage VGH and/or the low gate voltage VGL further to the scan driver 130. The level shifting unit 184 may generate, as the scan driver input signal SDIS, the scan start signal FLM and the scan clock signal SCLK by changing voltage levels of the initial scan start signal IFLM and the initial scan clock signal ISCLK based on at least one of the high gate voltage VGH or the low gate voltage VGL generated by the power block 190. In the non-driving frame period, the power block 190 may change the at least one of the high gate voltage VGH or the low gate voltage VGL to the off level. While the high gate voltage VGH and/or the low gate voltage VGL having the off level are received, the level shifting unit 184 may generate the scan start signal FLM and the scan clock signal SCLK having the low level, and the scan driver control block 180 may output the scan start signal FLM and the scan clock signal SCLK having the low level to the scan driver 130. Accordingly, in the non-driving frame period, because the high gate voltage VGH and/or the low gate voltage VGL have the off level, and the scan start signal FLM and the scan clock signal SCLK provided to the scan driver 130 also have the off level, the power consumption of the display device 100 may be further reduced in the non-driving frame period.

In some example embodiments, the scan driver control block 180 may provide the scan output masking signal SOMS to the scan driver 130 in a partial period of the driving frame period assigned to a portion of the plurality of partial panel zones PPZ1 and PPZ2, so that the plurality of partial panel zones PPZ1 and PPZ2 may be driven at the plurality of different driving frequencies DF1 and DF2, or so that the scan signals SS may not be provided to the portion (e.g., a partial panel zone driven at a frequency lower than the maximum driving frequency of the plurality of driving frequencies DF1 and DF2) of the plurality of partial panel zones PPZ1 and PPZ2 within at least one driving frame period. In some example embodiments, an operation that selectively provides the scan signals SS may be referred to as a masking operation. For example, as illustrated in FIG. 6, the scan driver input signal generating unit 182 may further generate an initial scan output masking signal ISOMS, the level shifting unit 184 may further generate the scan output masking signal SOMS by a voltage level of the initial scan output masking signal ISOMS based on the high gate voltage VGH and/or the low gate voltage VGL, and the scan driver control block 180 may output the scan output masking signal SOMS to the scan driver 130.

To perform the masking operation in response to the scan output masking signal SOMS, the scan driver 130 may include, as illustrated in FIG. 7, a plurality of stages 131, 132, 133, 134, . . . , and a plurality of logic gates 136, 137, 138, 139, . . . respectively connected to the plurality of stages 131, 132, 133, 134, . . . .

The plurality of stages 131, 132, 133, 134, . . . may generate a plurality of intermediate scan signals ISS1, ISS2, ISS3, ISS4, . . . respectively for a plurality of scan lines included in the display panel 110 based on the scan start signal FLM and the scan clock signal SCLK. In some example embodiments, the scan clock signal SCLK may include, but not be limited to, a plurality of clock signals having different phases.

The plurality of logic gates 136, 137, 138, 139, . . . may selectively output, a plurality of scan signals SS1, SS2, SS3, SS4, . . . , the plurality of intermediate scan signals ISS1, ISS2, ISS3, ISS4, . . . generated by the plurality of stages 131, 132, 133, 134, . . . in response to the scan output masking signal SOMS, respectively. In some example embodiments, as illustrated in FIG. 7, the plurality of logic gates 136, 137, 138, 139, . . . may be, but not be limited to, OR gates that perform OR operations on the plurality of intermediate scan signals ISS1, ISS2, ISS3, ISS4, . . . and the scan output masking signal SOMS. For example, each logic gate (e.g., 136) may output a corresponding scan single (e.g., SS1) having a low level when both of a corresponding intermediate scan signal ISS1 and the scan output masking signal SOMS have the low level.

For example, as illustrated in FIGS. 8 and 9, the zone splitting block 150 may receive, as the input image data IDAT, frame data FDAT at the input frame frequency IFF of about 120 Hz from the external host, and may divide the frame data FDAT into the first partial image data PDAT1 for the first partial panel zone PPZ1 including 1st through 1000th scan lines SL1 through SL1000 (or 1000 pixel rows connected to the 1st through 1000th scan lines SL1 through SL1000) and the second partial image data PDAT2 for the second partial panel zone PPZ2 including 1001st through 2000th scan lines SL1001 through SL2000 (or 1000 pixel rows connected to the 1001st through 2000th scan lines SL1001 through SL2000). The first panel zone frequency deciding block 162 may determine whether the first partial image data PDAT1 represent the still image, and the second panel zone frequency deciding block 164 may determine whether the second partial image data PDAT2 represent the still image. When the first partial image data PDAT1 represent the still image, the first panel zone frequency deciding block 162 may determine the first driving frequency DF1 for the first partial panel zone PPZ1 as about 60 Hz based on a flicker value of the first partial image data PDAT1. When the second partial image data PDAT2 represent the still image, the second panel zone frequency deciding block 164 may determine the second driving frequency DF2 for the second partial panel zone PPZ2 as about 30 Hz based on a flicker value of the second partial image data PDAT2.

The non-driving period setting block 170 may set one frame period (e.g., FP2) among two frame periods (e.g., FP1 and FP2) as the non-driving frame period NDFP based on the first driving frequency DF1 of about 60 Hz which is the maximum driving frequency of the first and second driving frequencies DF1 and DF2. In other words, the non-driving period setting block 170 may classify a plurality of frame periods FP1 through FP8 into the diving frame period and the non-driving frame period NDFP based on the maximum driving frequency, or the first driving frequency DF1 of about 60 Hz. Here, the diving frame period may be a frame period in which at least one of the plurality of partial panel zones PPZ1 or PPZ2 is driven, and the non-driving frame period NDFP may be a frame period in which all of the plurality of partial panel zones PPZ1 and PPZ2 are not driven. For example, among first through eighth frame periods FP1 through FP8, the non-driving period setting block 170 may classify first, third, fifth and seventh frame periods FP1, FP3, FP5 and FP7 as the driving frame periods, and may classify second, fourth, sixth and eighth frame periods FP2, FP4, FP6 and FP8 as the non-driving frame periods NDFP.

In the driving frame period in which all of the first and second partial panel zones PPZ1 and PPZ2 are driven, for example in the first frame period FP1 or the fifth frame period FP5, the controller 140 may provide the frame data FDAT including the first partial image data PDAT1 and the second partial image data PDAT2 to the data driver 120. Further, the scan driver control block 180 may provide the scan start signal FLM and the scan clock signal SCLK to the scan driver 130, the plurality of stages 131, 132, 133, 134, . . . of the scan deriver 130 may sequentially generate 1st through 2000th intermediate scan signals ISS1 through ISS2000 based on the scan start signal FLM and the scan clock signal SCLK, and the plurality of logic gates 136, 137, 138, 139, . . . of the scan driver 130 may sequentially output the 1st through 2000th intermediate scan signals ISS1 through ISS2000 as 1st through 2000th scan signals SS1 through SS2000. Thus, the scan driver 130 may sequentially provide the 1st through 1000th scan signals SS1 through SS1000 to the first partial panel zone PPZ1, and may sequentially provide the 1001st through 2000th scan signals SS1001 through SS2000 to the second partial panel zone PPZ2.

In the non-driving frame period NDFP in which all of the first and second partial panel zones PPZ1 and PPZ2 are not driven, for example in the second, fourth, sixth or eighth frame period FP2, FP4, FP6 or FPB, the controller 140 may not provide the output image data ODAT to the data driver 120. Further, in the non-driving frame period NDFP, the power block 190 may change at least one of the high gate voltage VGH or the low gate voltage VGL to the off level. For example, in the non-driving frame period NDFP, the power block 190 may change the high gate voltage VGH of about 7V to the off level of about 0V, and may change the low gate voltage VGL of about −8V to the off level of about 0V. Thus, in the non-driving frame period NDFP, the scan start signal FLM and the scan clock signal SCLK having an on level (e.g., about −8V) may be changed to the off level of about 0V based on the low gate voltage VGL having the off level of about 0V. Accordingly, the plurality of stages 131, 132, 133, 134, . . . of the scan deriver 130 may not generate the 1st through 2000th intermediate scan signals ISS1 through ISS2000, and thus the scan deriver 130 may not generate the 1st through 2000th scan signals SS1 through SS2000.

Even if a conventional display device drives the first and second partial panel zones PPZ1 and PPZ2 at the different first and second driving frequencies DF1 and DF2, in the non-driving frame period NDFP in which all of the first and second partial panel zones PPZ1 and PPZ2 are not driven, a scan driver of the conventional display device may generate the scan signals SS, but may not output the scan signals SS by performing the masking operation. Thus, in the conventional display device, even in the non-driving frame period NDFP, the scan driver input signal SDIS may be provided to the scan driver, and the scan driver may generate the scan signals SS. However, in the display device 100 according to some example embodiments, in the non-driving frame period NDFP, the scan driver input signal SDIS may not be provided to the scan driver 130, or the scan driver input signal SDIS having the off level may be provided to the scan driver 130. Thus, in the non-driving frame period NDFP, the scan driver 130 may not generate the scan signals SS (or the 1st through 2000th intermediate scan signals ISS1 through ISS2000). Accordingly, the power consumption of the scan driver 130, or the power consumption of the display device 100 may be further reduced.

In the driving frame period in which a portion of the first and second partial panel zones PPZ1 and PPZ2, or the first partial panel zone PPZ1 is driven, for example in the third frame period FP3 or the seventh frame period FP7, the controller 140 may provide only the first partial image data PDAT1 to the data driver 120. Further, the scan driver control block 180 may provide the scan start signal FLM and the scan clock signal SCLK to the scan driver 130, and may further provide the scan output masking signal SOMS in a partial period of the driving frame period assigned to the non-driven second partial panel zone PPZ2. The plurality of stages 131, 132, 133, 134, . . . of the scan deriver 130 may sequentially generate the 1st through 2000th intermediate scan signals ISS1 through ISS2000 based on the scan start signal FLM and the scan clock signal SCLK. The plurality of logic gates 136, 137, 138, 139, . . . of the scan driver 130 may sequentially output the 1st through 1000th intermediate scan signals ISS1 through ISS1000 as the 1st through 1000th scan signals SS1 through SS1000, and may not output the 1001st through 2000th intermediate scan signals ISS1001 through ISS2000, or the 1001st through 2000th scan signals SS1001 through SS2000 in response to the scan output masking signal SOMS. Thus, in the third frame period FP3 or the seventh frame period FP7, the scan driver 130 may sequentially provide the 1st through 1000th scan signals SS1 through SS1000 to the first partial panel zone PPZ1, and may not provide the 1001st through 2000th scan signals SS1001 through SS2000 to the second partial panel zone PPZ2.

Accordingly, among the first through eighth frame periods FP1 through FP8, the first partial panel zone PPZ1 may be driven in the first, third, fifth and seventh frame periods FP1, FP3, FP5 and FP7, and the second partial panel zone PPZ2 may be driven in the first and fifth frame periods FP1 and FP5. Thus, the first partial panel zone PPZ1 may be driven at the first driving frequency DF1 of about 60 Hz, and the second partial panel zone PPZ2 may be driven at the second driving frequency DF2 of about 30 Hz.

As described above, the display device 100 according to some example embodiments may perform the multi-frequency driving (MFD) that drives the first and second partial panel zones PPZ1 and PPZ2 of the display panel 110 at the different first and second driving frequencies DF1 and DF2. Accordingly, the power consumption of the display device 100 may be reduced. Further, the display device 100 according to some example embodiments may set the non-driving frame period NDFP based on the maximum driving frequency of the first and second driving frequencies DF1 and DF2 for the first and second partial panel zones PPZ1 and PPZ2, and may not provide the scan driver input signal SDIS to the scan driver 130 in the non-driving frame period NDFP. Accordingly, the power consumption of the scan driver 130 may be reduced, and the power consumption of the display device 100 may be further reduced.

Figure 10:
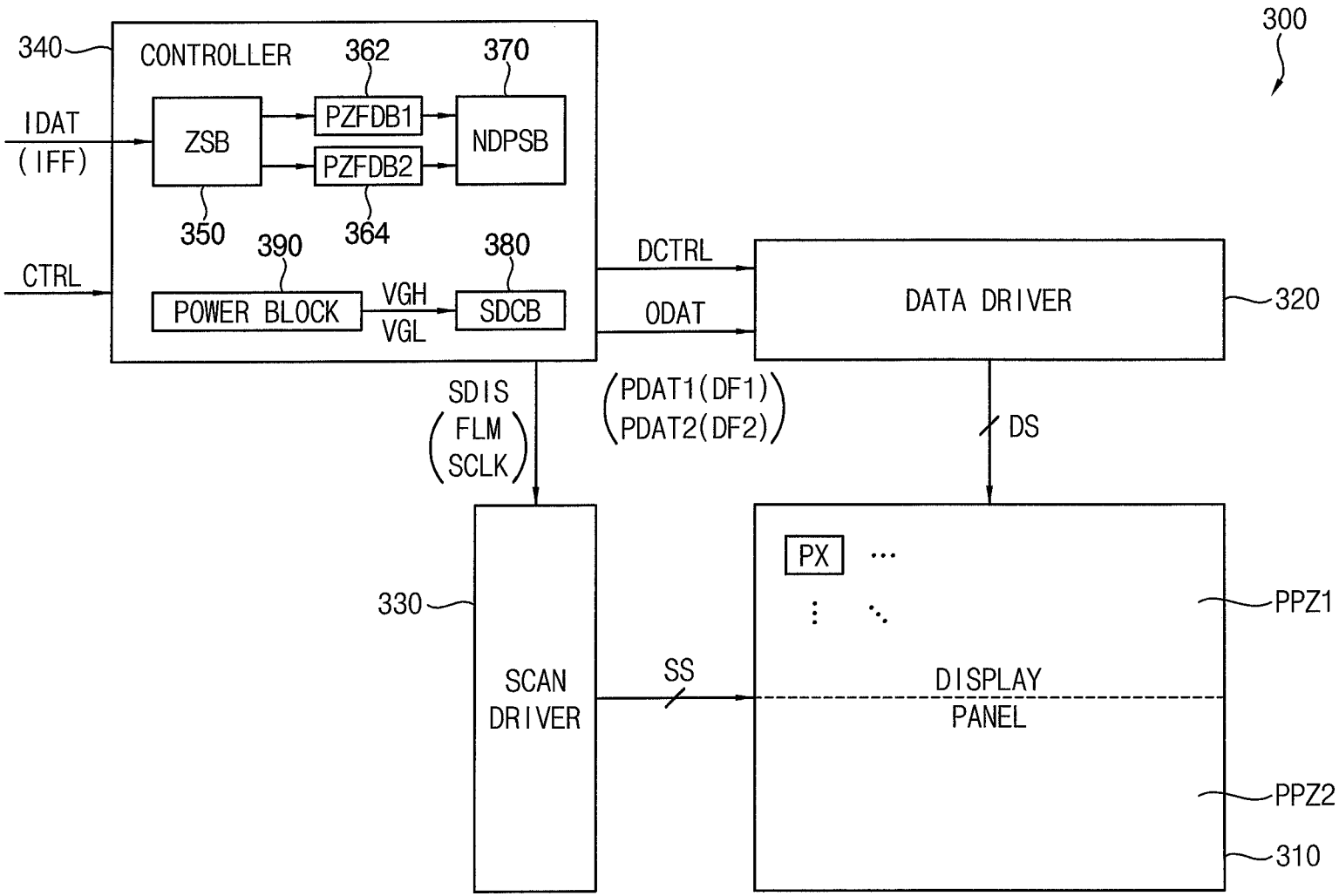
FIG. 10 is a block diagram illustrating a display device according to some example embodiments.
Figure 11:
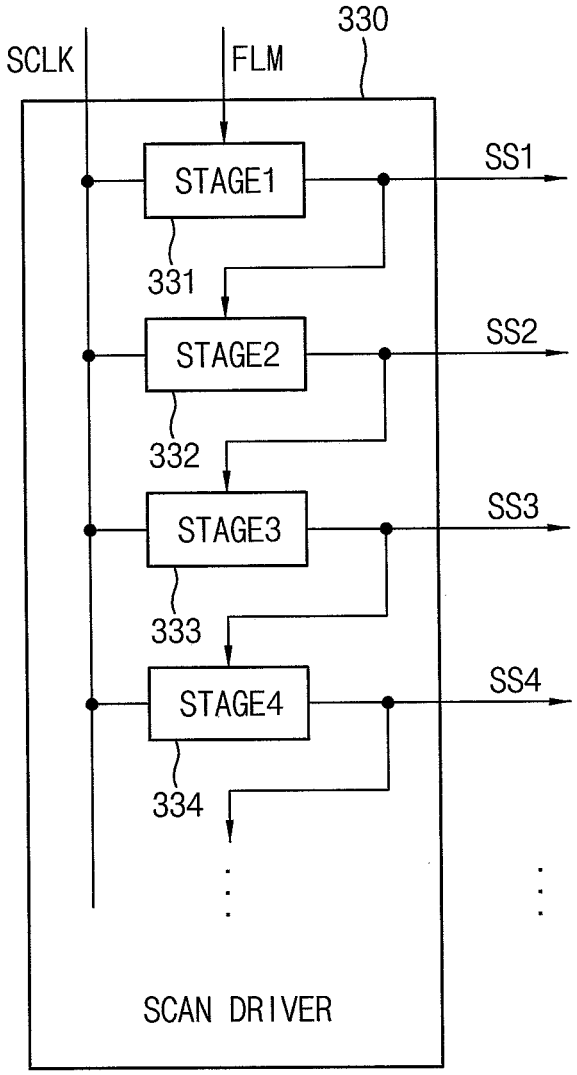
FIG. 11 is a block diagram illustrating an example of a scan driver included in a display device of FIG. 10.
Figure 12:
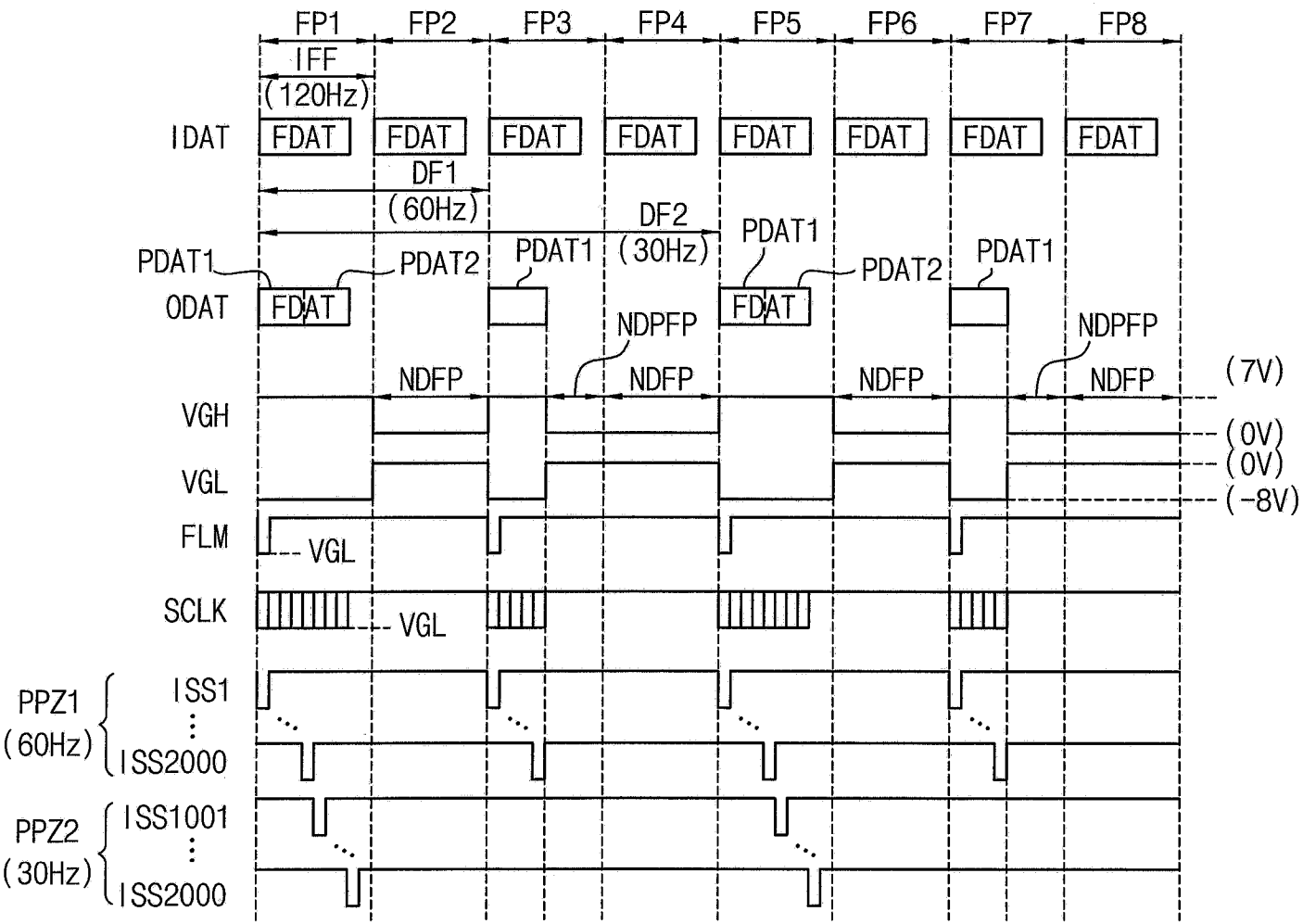
FIG. 12 is a timing diagram for describing an example of an operation of a display device according to some example embodiments.

FIG. 10 is a block diagram illustrating a display device according to some example embodiments, FIG. 11 is a block diagram illustrating an example of a scan driver included in a display device of FIG. 10, and FIG. 12 is a timing diagram for describing an example of an operation of a display device according to some example embodiments.

Referring to FIG. 10, a display device 300 according to some example embodiments may include a display panel 310, a data driver 320, a scan driver 330 and a controller 340. In some example embodiments, the controller 340 may include a zone splitting block 350, first and second panel zone frequency deciding blocks 362 and 364, a non-driving period setting block 370, a scan driver control block 380 and a power block 390. The display device 300 of FIG. 10 may have a similar configuration and a similar operation to a display device 100 of FIG. 1, except that a scan output masking signal SOMS may not be used, and a scan driver input signal SDIS may not be provided to the scan driver 330 not only in a non-driving frame period but also in a partial period of at least one driving frame period (which may be referred to as a non-driving partial frame period).

In some example embodiments, unlike a scan driver 130 of FIG. 10, the scan driver 330 included in the display device 300 of FIG. 10 may not receive the scan output masking signal SOMS, and may not include a plurality of logic gates 136, 137, 138, 139, . . . . For example, as illustrated in FIG. 11, the scan driver 330 may include a plurality of stages 331, 332, 333, 334, . . . that generate a plurality of scan signals SS1, SS2, SS3, SS4, . . . respectively for a plurality of scan lines included in the display panel 310 based on a scan start signal FLM and a scan clock signal SCLK.

For example, as illustrated in FIGS. 8 and 12, in a case where input image data DAT are received at an input frame frequency IFF of about 120 Hz, a first driving frequency DF1 for a first partial panel zone PPZ1 is determined as about 60 Hz, and a second driving frequency DF2 for a second partial panel zone PPZ2 is determined as about 30 Hz, the non-driving period setting block 370 may set second, fourth, sixth and eighth frame periods FP2, FP4, FP6 and FP8 as non-driving frame periods NDFP based on the maximum driving frequency, or the first driving frequency DF1 of about 60 Hz. Further, the non-driving period setting block 370 may set a partial period of a driving frame period in which a portion of the first and second partial panel zones PPZ1 and PPZ2 is driven as the non-driving partial frame period NDPFP based on a driving frequency lower than the maximum driving frequency among the first and second driving frequencies DF1 and DF2, or the second driving frequency DF2. For example, only the first partial panel zone PPZ1 is driven in a third frame period FP3 and a seventh frame period FP7, and the non-driving period setting block 370 may set a partial period of the third frame period FP3 and a partial period of the seventh frame period FP7 as the non-driving partial frame periods NDPFP.

The scan driver control block 380 may not provide the scan driver input signal SDIS to the scan driver 330 in the non-driving frame period NDFP and the non-driving partial frame period NDPFP. The power block 390 may change at least one of a high gate voltage VGH or a low gate voltage VGL to an off level not only in the non-driving frame period NDFP but also in the non-driving partial frame period NDPFP. Thus, the scan start signal FLM and the scan clock signal SCLK also may have the off level of about 0V in the non-driving frame period NDFP and the non-driving partial frame period NDPFP. Accordingly, the scan driver 330 may not generate 1st through 2000th scan signals SS1 through SS2000 in the non-driving frame period NDFP, may generate the 1st through 1000th scan signals SS1 through SS1000 in a partial period of the third frame period FP3 or the seventh frame period FP7, and may not generate the 1001st through 2000th scan signals SS1001 through SS2000 in the remaining period of the third frame period FP3 or the seventh frame period FP7, or in the non-driving partial frame period NDPFP.

As described above, the display device 300 according to some example embodiments may not provide the scan driver input signal SDIS to the scan driver 330 not only in non-driving frame period NDFP but also in the non-driving partial frame period NDPFP by changing the high gate voltage VGH and/or the low gate voltage VGL to the off level. Accordingly, the power consumption of the scan driver 330 may be further reduced, and the power consumption of the display device 300 may be further reduced.

Figure 13:
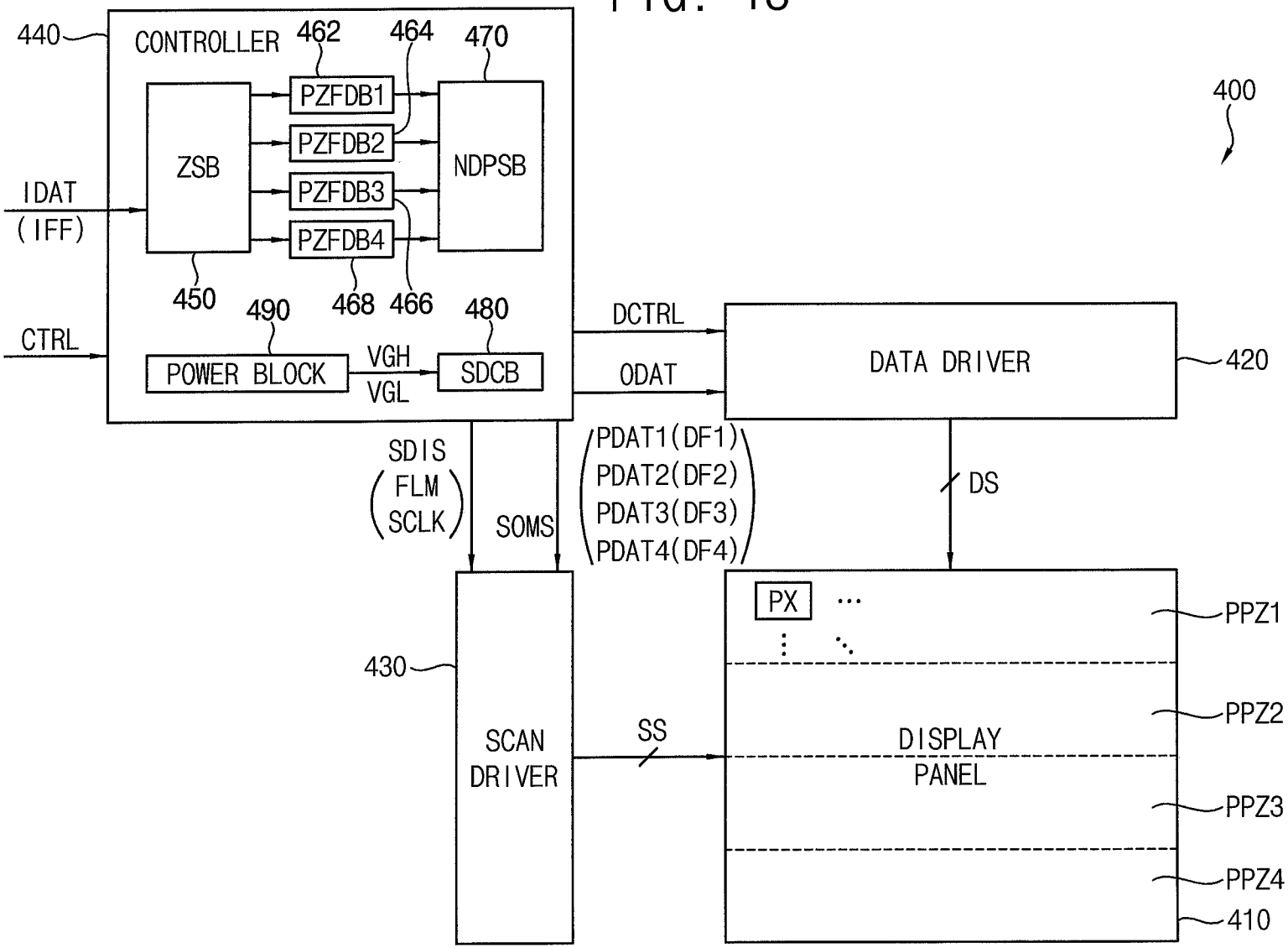
FIG. 13 is a block diagram illustrating a display device according to some example embodiments.
Figure 14:
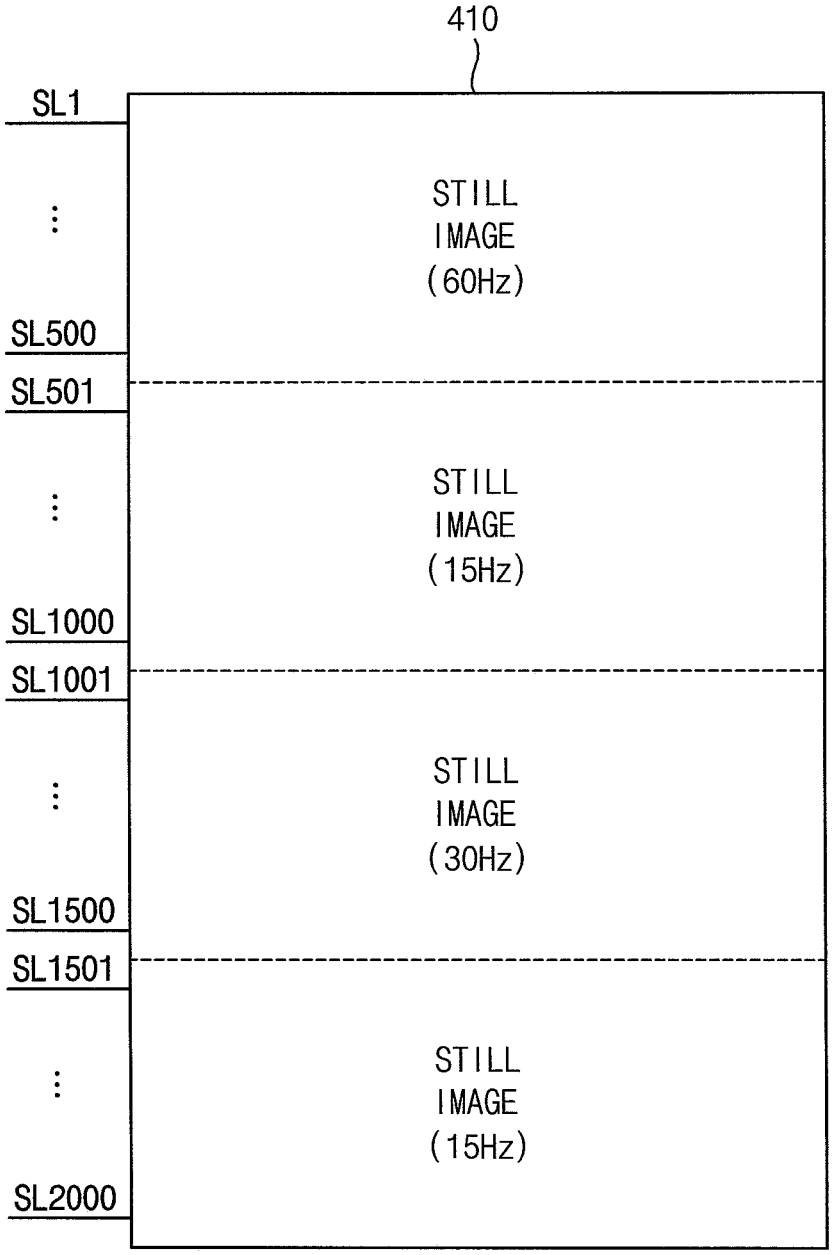
FIG. 14 is a diagram for describing an example of first through fourth driving frequencies determined for first through fourth partial panel zones of a display panel.
Figure 15:
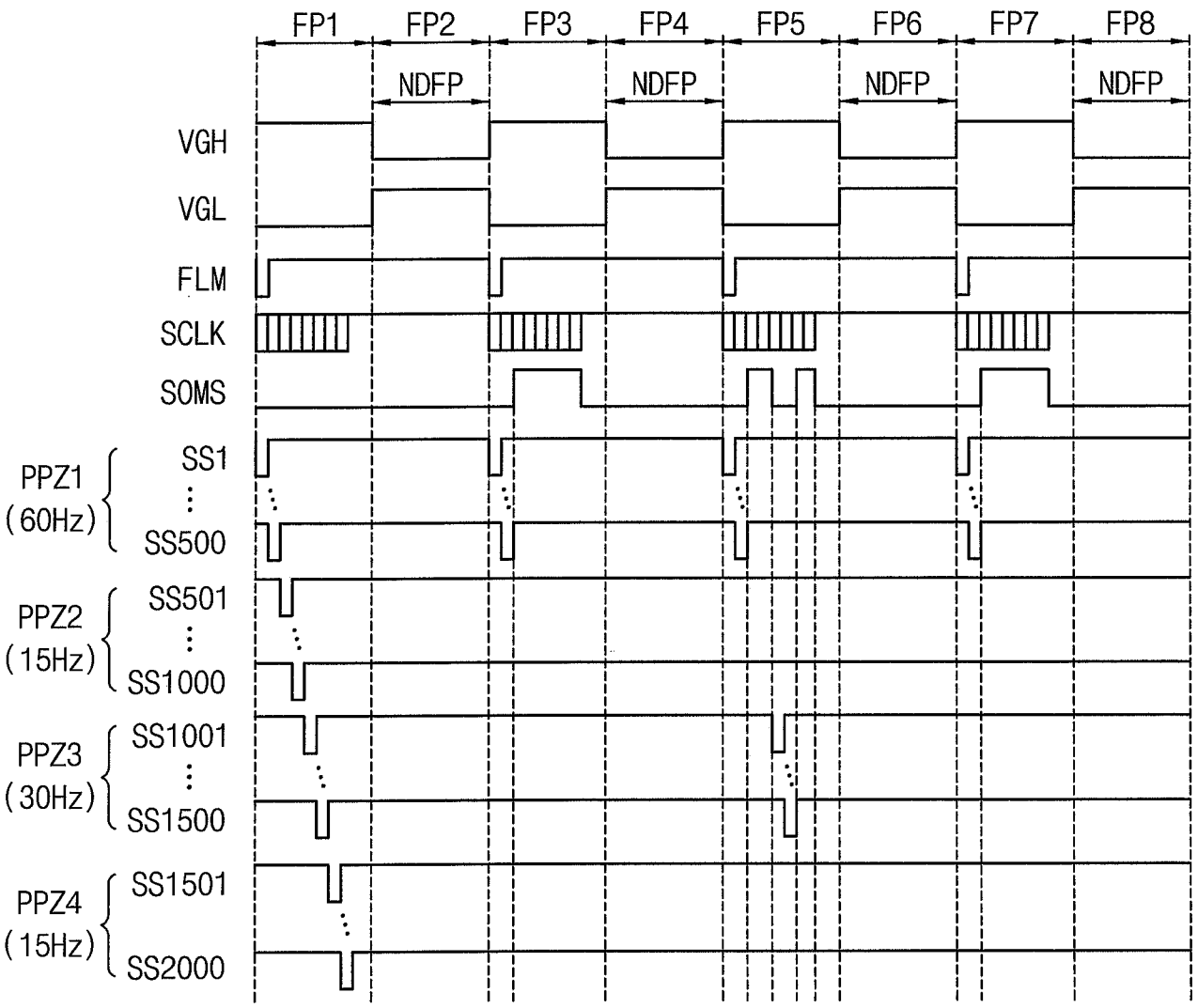
FIG. 15 is a timing diagram for describing an example of an operation of a display device according to some example embodiments.

FIG. 13 is a block diagram illustrating a display device according to some example embodiments, FIG. 14 is a diagram for describing an example of first through fourth driving frequencies determined for first through fourth partial panel zones of a display panel, and FIG. 15 is a timing diagram for describing an example of an operation of a display device according to some example embodiments.

Referring to FIG. 13, a display device 400 according to some example embodiments may include a display panel 410, a data driver 420, a scan driver 430 and a controller 440. In some example embodiments, the controller 440 may include a zone splitting block 450, first through fourth panel zone frequency deciding blocks 462, 464, 466 and 468, a non-driving period setting block 470, a scan driver control block 480 and a power block 490. The display device 400 of FIG. 13 may have a similar configuration and a similar operation to a display device 100 of FIG. 1, except that input image data IDAT may be divided into first through fourth partial image data PDAT1, PDAT1, PDAT3 and PDAT4 for first through fourth partial panel zones PPZ1, PPZ2, PPZ3 and PPZ4, and the first through fourth partial panel zones PPZ1, PPZ2, PPZ3 and PPZ4 may be driven at first through fourth driving frequencies DF1, DF2, DF3 and DF4.

For example, as illustrated in FIGS. 14 and 15, the zone splitting block 450 may receive, as the input image data IDAT, frame data FDAT at an input frame frequency IFF of about 120 Hz, and may divide the frame data FDAT into the first partial image data PDAT1 for the first partial panel zone PPZ1 including 1st through 500th scan lines SL1 through SL500, the second partial image data PDAT2 for the second partial panel zone PPZ2 including 501st through 1000th scan lines SL501 through SL1000, the third partial image data PDAT3 for the third partial panel zone PPZ3 including 1001st through 1500th scan lines SL1001 through SL1500, and the fourth partial image data PDAT4 for the fourth partial panel zone PPZ4 including 1501st through 2000th scan lines SL1501 through SL2000. The first through fourth panel zone frequency deciding blocks 462, 464, 466 and 468 may determine the first through fourth driving frequencies DF1, DF2, DF3 and DF4 for the first through fourth partial panel zones PPZ1, PPZ2, PPZ3 and PPZ4 as about 60 Hz, about 15 Hz, about 30 Hz and about 15 Hz by analyzing the first through fourth partial image data PDAT1, PDAT1, PDAT3 and PDAT4, respectively.

The non-driving period setting block 470 may set one frame period (e.g., FP2) among two frame periods (e.g., FP1 and FP2) as a non-driving frame period NDFP based on the first driving frequency DF1 of about 60 Hz which is the maximum driving frequency of the first through fourth driving frequencies DF1, DF2, DF3 and DF4. For example, the non-driving period setting block 470 may classify second, fourth, sixth and eighth frame periods FP2, FP4, FP6 and FP8 as the non-driving frame periods NDFP.

In the driving frame period in which all of the first through fourth partial panel zones PPZ1, PPZ2, PPZ3 and PPZ4 are driven, for example in the first frame period FP1, the scan driver control block 480 may provide a scan start signal FLM and a scan clock signal SCLK to the scan driver 430, and the scan driver 430 may sequentially provide 1st through 2000th scan signals SS1 through SS2000 to the first through fourth partial panel zones PPZ1, PPZ2, PPZ3 and PPZ4.

In the non-driving frame period NDFP in which all of the first through fourth partial panel zones PPZ1, PPZ2, PPZ3 and PPZ4 are not driven, for example in the second, fourth, sixth or eighth frame period FP2, FP4, FP6 or FP8, the power block 490 may change at least one of a high gate voltage VGH or a low gate voltage VGL to an off level, and the scan driver control block 480 may not provide the scan start signal FLM and the scan clock signal SCLK to the scan driver 430. Accordingly, the scan deriver 430 may not generate the 1st through 2000th scan signals SS1 through SS2000.

In the driving frame period in which a portion of the first through fourth partial panel zones PPZ1, PPZ2, PPZ3 and PPZ4 is driven, the scan driver control block 480 may provide the scan start signal FLM, the scan clock signal SCLK and a scan output masking signal SOMS to the scan driver 430. For example, in a third frame period FP3 or a seventh frame period FP7 in which only the first partial panel zone PPZ1 is driven, the scan driver 430 may sequentially provide the 1st through 500th scan signals SS1 through SS500 to the first partial panel zone PPZ1. Further, in a fifth frame period FP5 in which only the first and third partial panel zones PPZ1 and PPZ3 are driven, the scan driver 430 may sequentially provide the 1st through 500th scan signals SS1 through SS500 to the first partial panel zone PPZ1, and may sequentially provide the 1001st through 1500th scan signals SS1001 through SS1500 to the third partial panel zone PPZ3.

Accordingly, among the first through eighth frame periods FP1 through FP8, the first partial panel zone PPZ1 may be driven in the first, third, fifth and seventh frame periods FP1, FP3, FP5 and FP7, the second partial panel zone PPZ2 may be driven in the first frame period FP1, the third partial panel zone PPZ3 may be driven in the first and fifth frame periods FP1 and FP5, and the fourth partial panel zone PPZ4 may be driven in the first frame period FP1. Thus, the first partial panel zone PPZ1 may be driven at the first driving frequency DF1 of about 60 Hz, the second partial panel zone PPZ2 may be driven at the second driving frequency DF2 of about 15 Hz, the third partial panel zone PPZ3 may be driven at the third driving frequency DF3 of about 30 Hz, and the fourth partial panel zone PPZ4 may be driven at the fourth driving frequency DF4 of about 15 Hz.

As described above, the display device 400 according to some example embodiments may perform the multi-frequency driving (MFD) that drives the first through fourth partial panel zones PPZ1, PPZ2, PPZ3 and PPZ4 of the display panel 410 at the different first through fourth driving frequencies DF1, DF2, DF3 and DF4. Accordingly, the power consumption of the display device 400 may be reduced. Further, the display device 400 according to some example embodiments may set the non-driving frame period NDFP based on the maximum driving frequency of the different first through fourth driving frequencies DF1, DF2, DF3 and DF4 for the first through fourth partial panel zones PPZ1, PPZ2, PPZ3 and PPZ4, and may not provide a scan driver input signal SDIS to the scan driver 430 in the non-driving frame period NDFP. Accordingly, the power consumption of the scan driver 430 may be reduced in the non-driving frame period NDFP, and the power consumption of the display device 400 may be further reduced.

Although FIG. 1 illustrates an example where a display panel 110 is divided into two partial panel zones PPZ1 and PPZ2, and FIG. 13 illustrates an example where the display panel 410 is divided into fourth partial panel zones PPZ1, PPZ2, PPZ3 and PPZ4, the display panel according to some example embodiments may be divided into any number of partial panel zones.

Figure 16:
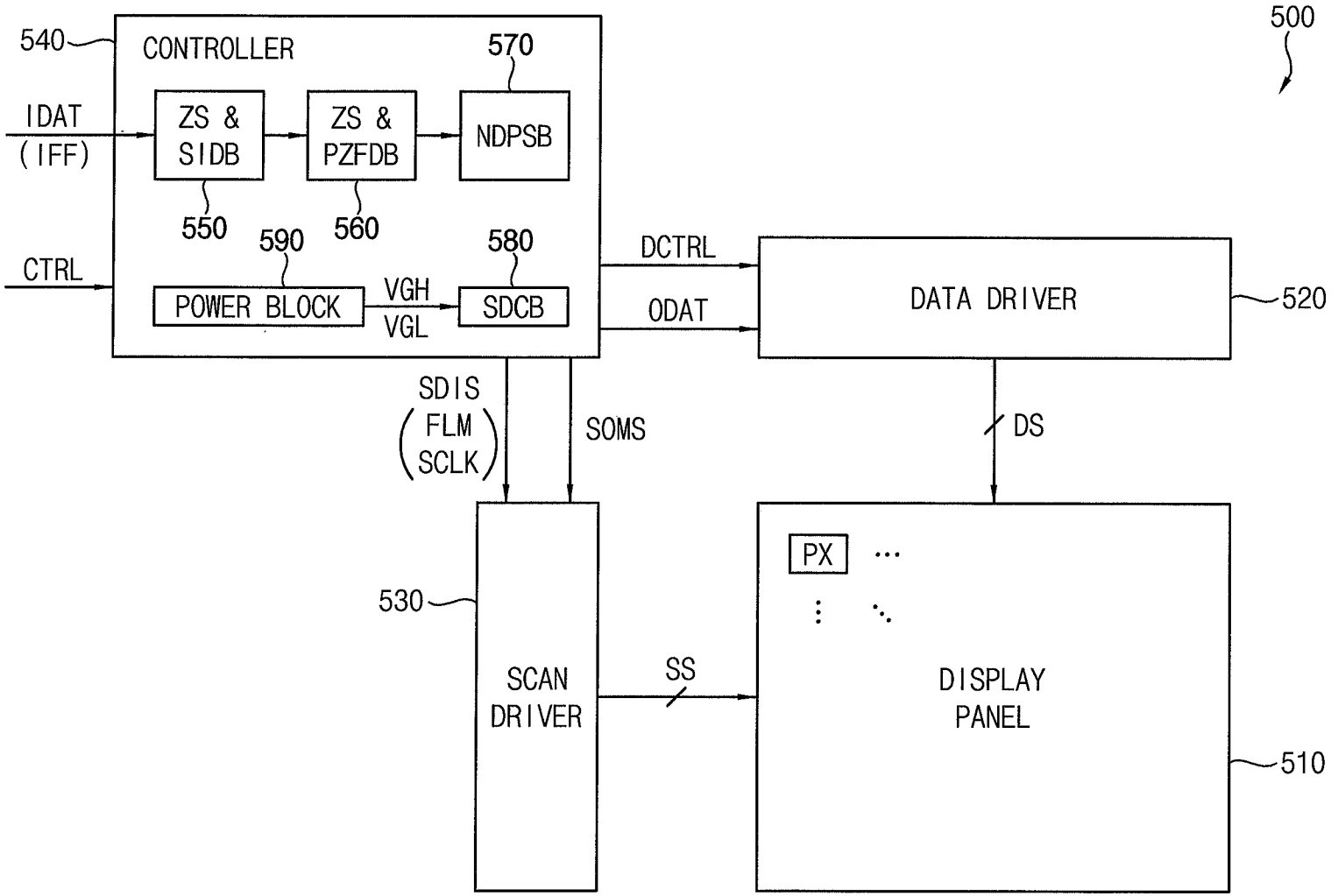
FIG. 16 is a block diagram illustrating a display device according to some example embodiments.
Figure 17:
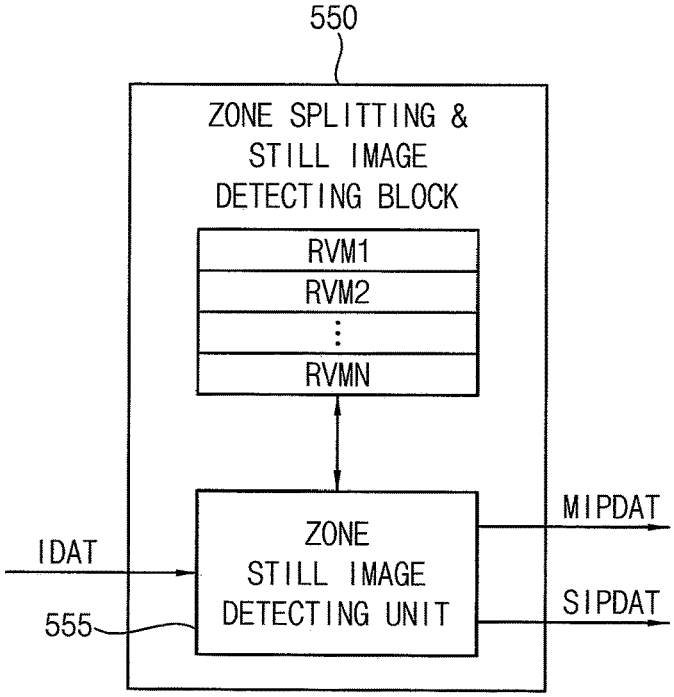
FIG. 17 is a block diagram illustrating an example of a zone splitting and still image detecting block included in a display device according to some example embodiments.
Figure 18:
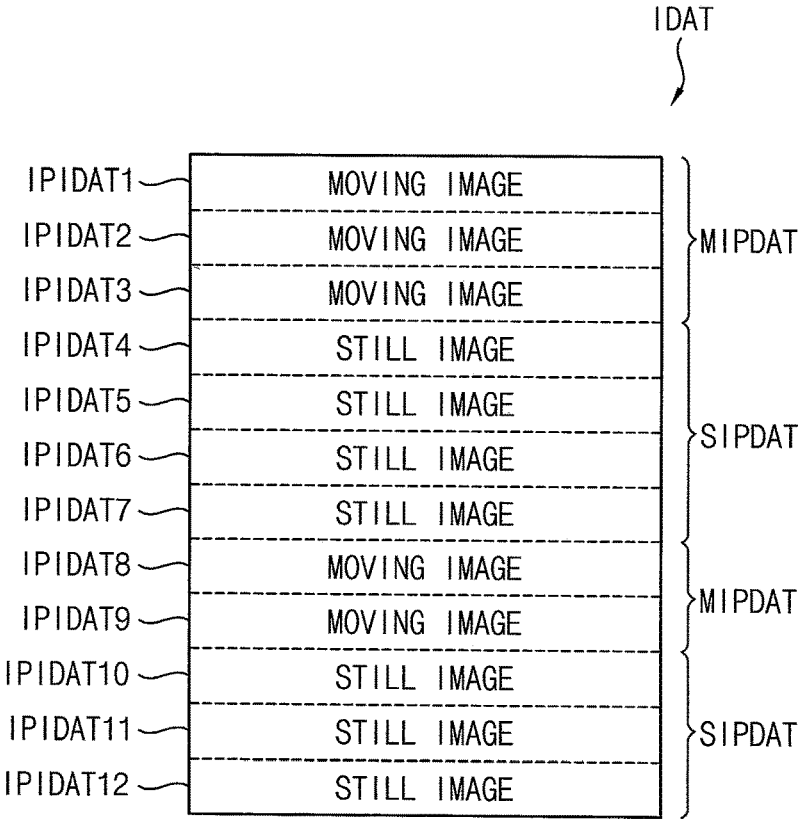
FIG. 18 is a diagram for describing an example of an operation of a zone splitting and still image detecting block included in a display device according to some example embodiments.
Figure 19:
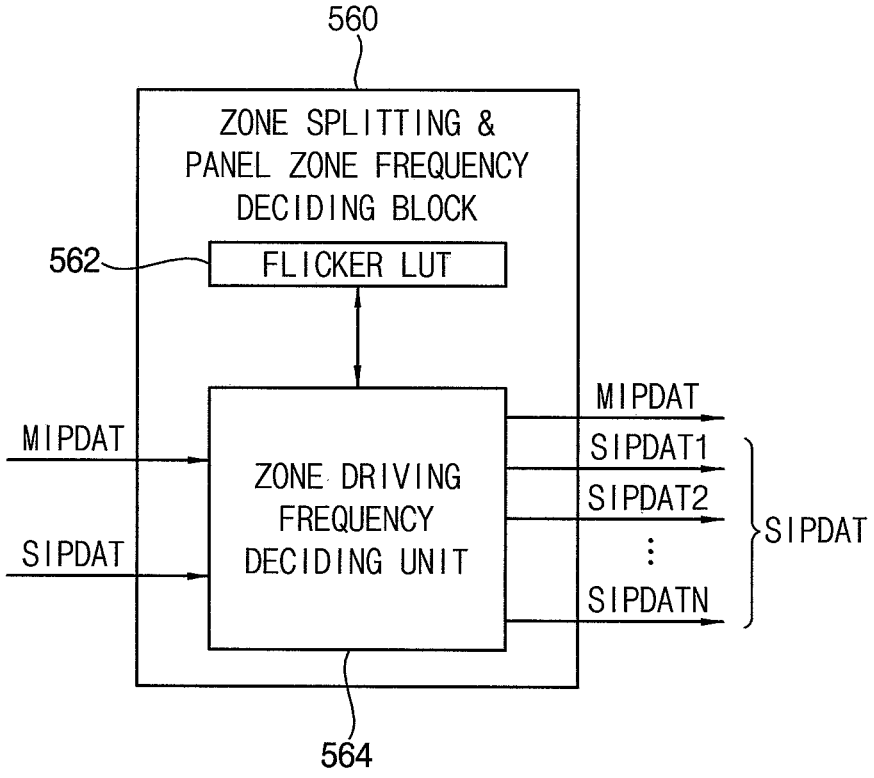
FIG. 19 is a block diagram illustrating an example of a zone splitting and panel zone frequency deciding block included in a display device according to some example embodiments.
Figure 20:
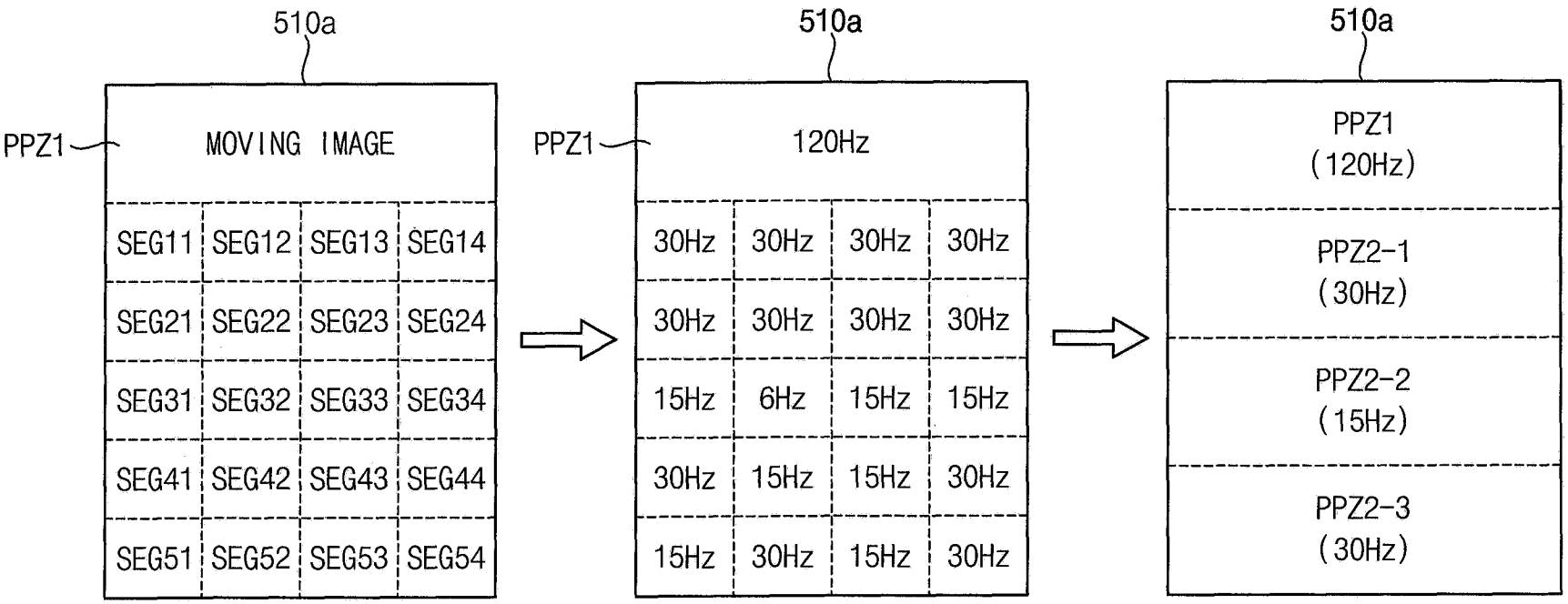
FIG. 20 is a diagram for describing an example of an operation of a zone splitting and panel zone frequency deciding block included in a display device according to some example embodiments.
Figure 21:
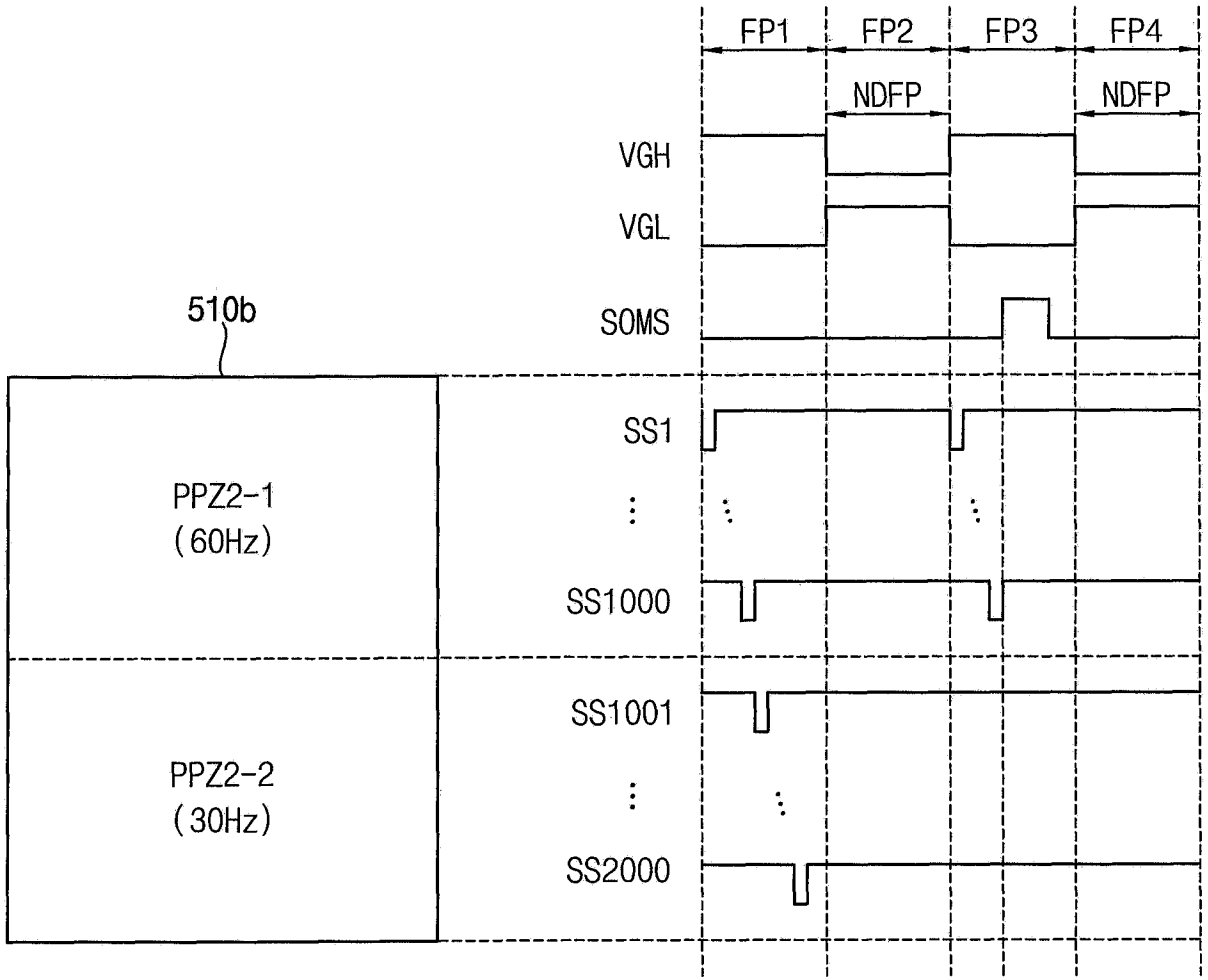
FIG. 21 is a diagram for describing an example of an operation of a display device according to some example embodiments.

FIG. 16 is a block diagram illustrating a display device according to some example embodiments, FIG. 17 is a block diagram illustrating an example of a zone splitting and still image detecting block included in a display device according to some example embodiments, FIG. 18 is a diagram for describing an example of an operation of a zone splitting and still image detecting block included in a display device according to some example embodiments, FIG. 19 is a block diagram illustrating an example of a zone splitting and panel zone frequency deciding block included in a display device according to some example embodiments, FIG. 20 is a diagram for describing an example of an operation of a zone splitting and panel zone frequency deciding block included in a display device according to some example embodiments, and FIG. 21 is a diagram for describing an example of an operation of a display device according to some example embodiments.

Referring to FIG. 16, a display device 500 according to some example embodiments may include a display panel 510, a data driver 520, a scan driver 530 and a controller 540. In some example embodiments, the controller 540 may include a zone splitting and still image detecting block 550, a zone splitting and panel zone frequency deciding block 560, a non-driving period setting block 570, a scan driver control block 580 and a power block 590.

The zone splitting and still image detecting block 550 may receive input image data IDAT at an input frame frequency IFF, and may divide the input image data IDAT into moving image partial data representing a moving image and still image partial data representing a still image. That is, the zone splitting and still image detecting block 550 may divide the input image data IDAT into the moving image partial data for a zone (or region) of the display panel 510 at which the moving image is to be displayed and the still image partial data for a zone (or region) of the display panel 510 at which the still image is to be displayed.

In some example embodiments, as illustrated in FIG. 17, the zone splitting and still image detecting block 550 may include a plurality of representative value memories RVM1, RVM2, . . . , RVMN, and a zone still image detecting unit 555. For example, referring to FIGS. 17 and 18, the plurality of representative value memories RVM1, RVM2, . . . , RVMN may store a plurality of representative values of a plurality of input partial image data IPIDAT1 through IPIDAT12 in a previous frame period. The zone still image detecting unit 555 may receive the input image data IDAT in a current frame period, and may divide the input image data IDAT in the current frame period into the plurality of input partial image data IPIDAT1 through IPIDAT12. A size of each input partial image data (e.g., IPIDAT1) may be varied according to some example embodiments. The zone still image detecting unit 555 may calculate a plurality of representative values of the plurality of input partial image data IPIDAT1 through IPIDAT12 in the current frame period, and may determine whether each of the plurality of input partial image data IPIDAT1 through IPIDAT12 represent the moving image or the still image by comparing the plurality of calculated representative values with the plurality of representative values stored in the plurality of representative value memories RVM1, RVM2, . . . , RVMN. The zone still image detecting unit 555 may output input partial image data IPIDAT1, IPIDAT2, IPIDAT3, IPIDAT8 and IPIDAT9 representing the moving image among the plurality of input partial image data IPIDAT1 through IPIDAT12 as the moving image partial data MIPDAT, and may output input partial image data IPIDAT4, IPIDAT5, IPIDAT6, IPIDAT7, IPIDAT10, IPIDAT11 and IPIDAT12 representing the still image among the plurality of input partial image data IPIDAT1 through IPIDAT12 as the still image partial data SIPDAT.

The zone splitting and panel zone frequency deciding block 560 may determine a first driving frequency for a first partial panel zone of the display panel 510 corresponding to the moving image partial data MIPDAT as the input frame frequency IFF, and may determine a plurality of second driving frequencies for a plurality of second partial panel zones of the display panel 510 by analyzing the still image partial data SIPDAT. Thus, the zone splitting and panel zone frequency deciding block 560 may divide the zone of the display panel 510 at which the still image is to be displayed into the plurality of second partial panel zones, and may determine the plurality of different second driving frequencies for the plurality of second partial panel zones.

In some example embodiments, as illustrated in FIG. 19, the zone splitting and panel zone frequency deciding block 560 may include a flicker lookup table (LUT) 562 and a zone driving frequency deciding unit 564. The flicker LUT 562 may store flicker values corresponding to respective image data gray levels (e.g., 256 gray levels from 0-gray level to 255-gray level as illustrated in FIG. 5). For example, referring to FIGS. 19 and 20, the zone driving frequency deciding unit 564 may determine the first driving frequency for the first partial panel zone PPZ1 of the display panel 510*a* corresponding to the moving image partial data MIPDAT as the input frame frequency IFF, for example about 120 Hz. Further, the zone driving frequency deciding unit 564 may divide the still image partial data SIPDAT into a plurality of segment data for a plurality of segments SEG11 through SEG54. A size of each segment (e.g., SEG11) may be varied according to some example embodiments. The zone driving frequency deciding unit 564 may determine a plurality of segment flicker values corresponding to gray levels of the plurality of segment data by using the flicker LUT 562, and may determine a plurality of segment driving frequencies corresponding to the plurality of segment flicker values. FIG. 20 illustrates an example where the plurality of segment driving frequencies are determined as about 30 Hz, about 30 Hz, about 30 Hz, about 30 Hz, about 30 Hz, about 30 Hz, about 30 Hz, about 30H z, about 15 Hz, about 6 Hz, about 15 Hz, about 15 Hz, about 30 Hz, about 15 Hz, about 15 Hz, about 30 Hz, about 15 Hz, about 30 Hz, about 15 Hz and about 30 Hz with respect to first through twentieth segments SEG11 through SEG54. The zone driving frequency deciding unit 564 may determine the plurality of second partial panel zones PPZ2-1, PPZ2-2 and PPZ2-3 by grouping the plurality of segments SEG11 through SEG54 based on the plurality of segment driving frequencies, and may respectively determine the plurality of second driving frequencies for the plurality of second partial panel zones PPZ2-1, PPZ2-2 and PPZ2-3 based on the plurality of segment driving frequencies of the plurality of second partial panel zones PPZ2-1, PPZ2-2 and PPZ2-3. The zone driving frequency deciding unit 564 may divide the still image partial data SIPDAT into a plurality of still image partial data SIPDAT1 through SIPDATN for the plurality of second partial panel zones PPZ2-1, PPZ2-2 and PPZ2-3, and may output plurality of still image partial data SIPDAT1 through SIPDATN. For example, the zone driving frequency deciding unit 564 may group the first through eighth segments SEG11 through SEG24 into one second partial panel zone PPZ2-1, and may determine the second driving frequency for the one second partial panel zone PPZ2-1 as about 30 Hz. Further, the zone driving frequency deciding unit 564 may group the ninth through twelfth segments SEG31 through SEG34 into another second partial panel zone PPZ2-2, and may determine the second driving frequency for the another second partial panel zone PPZ2-2 as about 15 Hz. Further, the zone driving frequency deciding unit 564 may group the thirteenth through twentieth segments SEG41 through SEG54 into still another second partial panel zone PPZ2-3, and may determine the second driving frequency for the still another second partial panel zone PPZ2-3 as about 30 Hz.

The non-driving period setting block 570 may classify a plurality of frame periods into a driving frame period and a non-driving frame period based on a maximum driving frequency of the first driving frequency and the plurality of second driving frequencies. For example, as illustrated in FIG. 21, in a case where the display panel 510*b* is divided into two second partial panel zones PPZ2-1 and PPZ2-2, and the second driving frequencies for the two second partial panel zones PPZ2-1 and PPZ2-2 are about 60 Hz and about 30 Hz, the non-driving period setting block 570 may set first and third frame periods FP1 and FP3 as the driving frame periods, and may set second and fourth frame periods FP2 and FP4 as the non-driving frame periods NDFP.

The scan driver control block 580 may provide a scan driver input signal SDIS to the scan driver 530 in the driving frame period, or in the first and third frame periods FP1 and FP3, and may not provide the scan driver input signal SDIS to the scan driver 530 in the non-driving frame period NDFP, or in the second and fourth frame periods FP2 and FP4. In some example embodiments, the scan driver control block 580 may not provide, as the scan driver input signal SDIS, a scan start signal FLM and a scan clock signal SCLK to the scan driver 530 in the non-driving frame period NDFP. For example, the power block 590 may change at least one of a high gate voltage VGH or a low gate voltage VGL to an off level in the non-driving frame period NDFP, and, based on the high gate voltage VGH and/or the low gate voltage VGL having the off level, the scan driver control block 580 may not provide the scan start signal FLM and the scan clock signal SCLK to the scan driver 530, or may provide the scan start signal FLM and the scan clock signal SCLK having the off level to the scan driver 530. Accordingly, in the non-driving frame period NDFP, the power consumption of the scan driver 530 may be reduced, and the power consumption of the display device 500 may be further reduced.

The scan driver control block 580 may provide a scan output masking signal SOMS to the scan driver 530 in the third frame period FP3 in which only one second partial panel zone PPZ2-1 is driven. In response to the scan output masking signal SOMS, the scan driver 530 may sequentially provide 1st through 1000th scan signals SS1 through SS1000 to the one second partial panel zone PPZ2-1, and may not provide 1001st through 2000th scan signals SS1001 through SS2000 to another second partial panel zone PPZ2-2.

Figure 22:
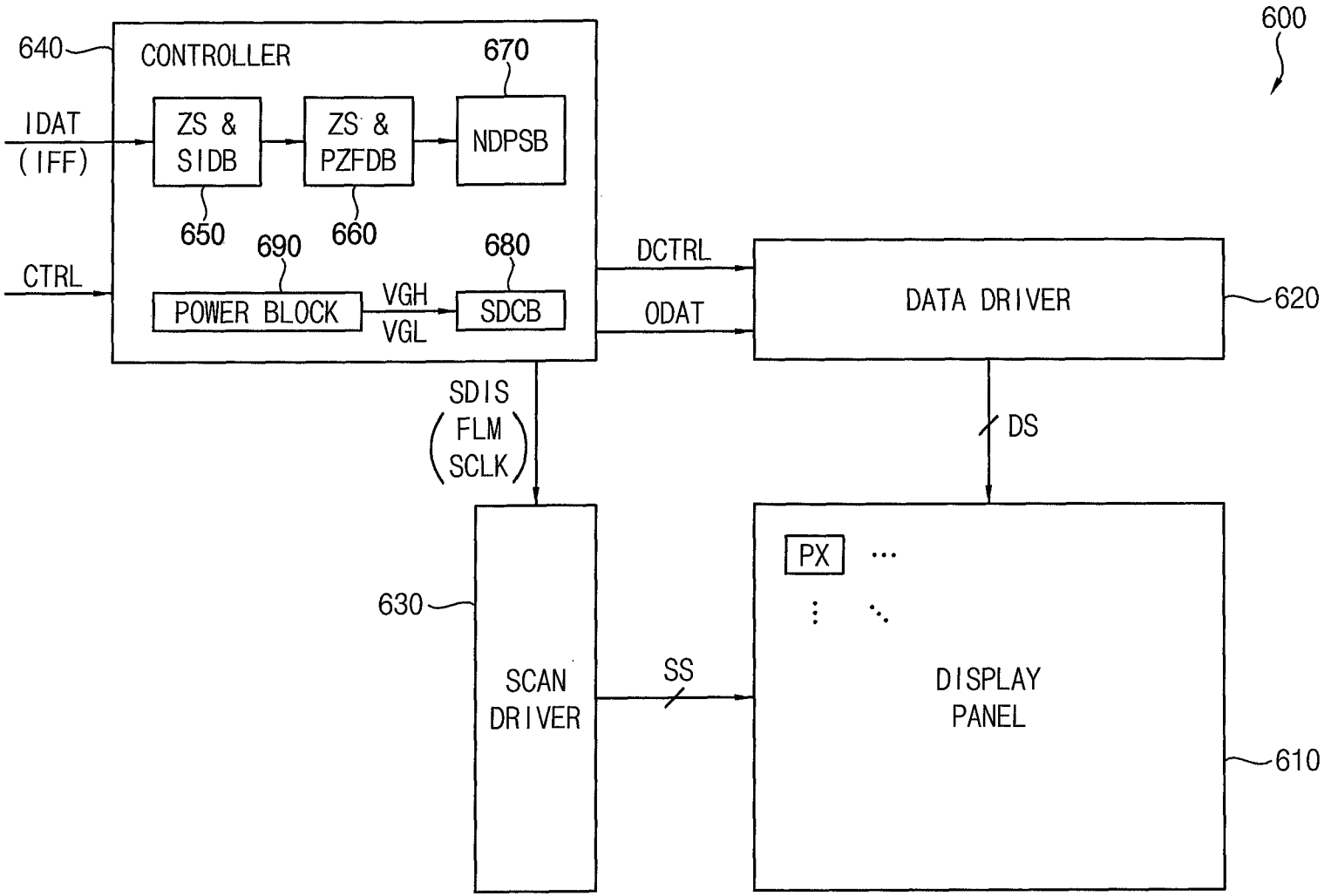
FIG. 22 is a block diagram illustrating a display device according to some example embodiments.
Figure 23:
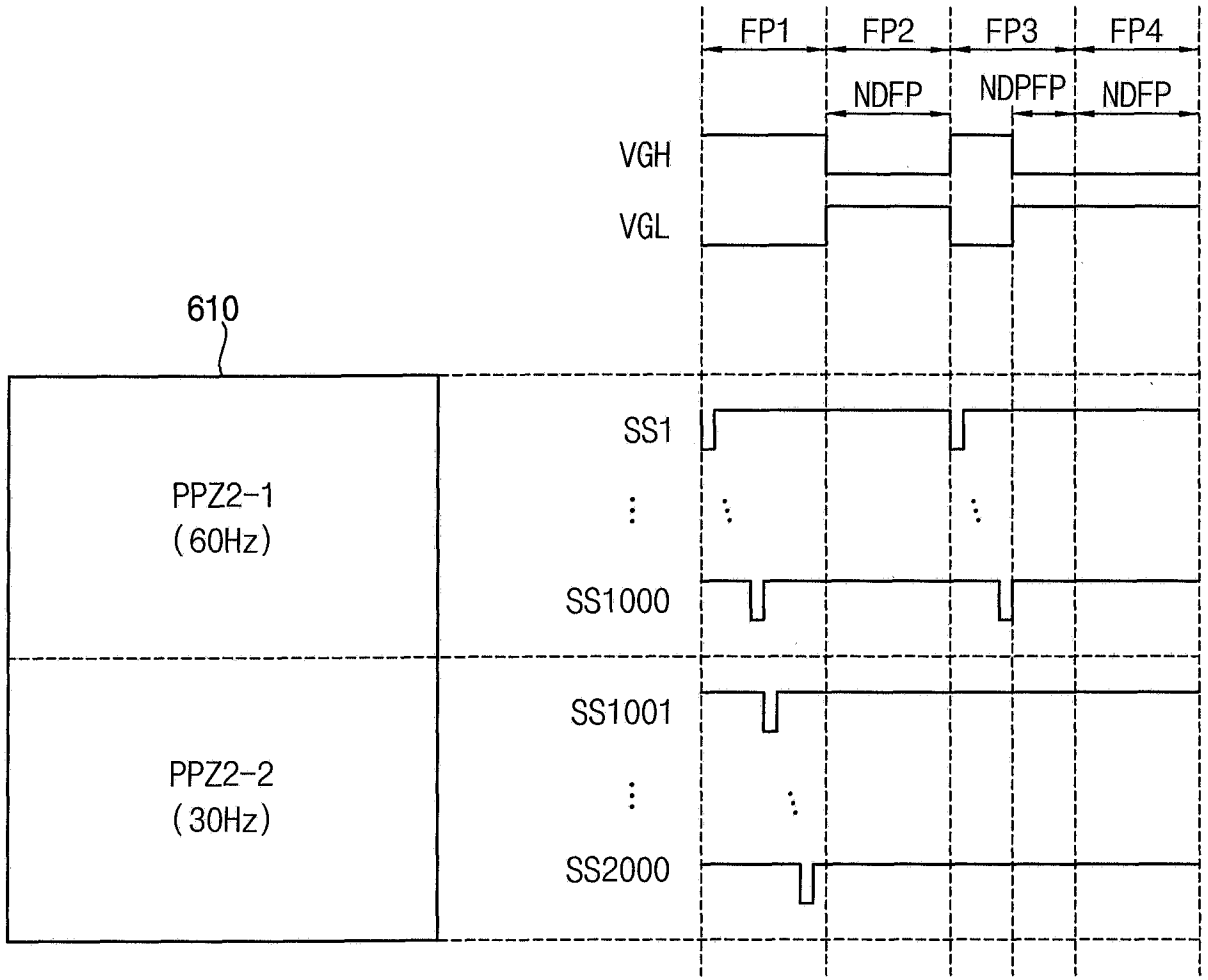
FIG. 23 is a diagram for describing an example of an operation of a display device according to some example embodiments.

FIG. 22 is a block diagram illustrating a display device according to some example embodiments, and FIG. 23 is a diagram for describing an example of an operation of a display device according to some example embodiments.

Referring to FIG. 22, a display device 600 according to some example embodiments may include a display panel 610, a data driver 620, a scan driver 630 and a controller 640. In some example embodiments, the controller 640 may include a zone splitting and still image detecting block 650, a zone splitting and panel zone frequency deciding block 660, a non-driving period setting block 670, a scan driver control block 680 and a power block 690. The display device 600 of FIG. 22 may have a similar configuration and a similar operation to a display device 500 of FIG. 16, except that a scan output masking signal SOMS may not be used, and a scan driver input signal SDIS may not be provided to the scan driver 630 not only in a non-driving frame period but also in a non-driving partial frame period.

For example, as illustrated in FIG. 23, in a case where the display panel 610 is divided into two second partial panel zones PPZ2-1 and PPZ2-2, and second driving frequencies for the two second partial panel zones PPZ2-1 and PPZ2-2 are about 60 Hz and about 30 Hz, the non-driving period setting block 670 may set second and fourth frame periods FP2 and FP4 in which all of the two second partial panel zones PPZ2-1 and PPZ2-2 are not driven as the non-driving frame periods NDFP, and may set a portion of a third frame period FP3 in which only one of the two second partial panel zones PPZ2-1 and PPZ2-2 is driven as the non-driving partial frame period NDPFP.

The scan driver control block 680 may not provide the scan driver input signal SDIS to the scan driver 630 in the non-driving frame period NDFP and the non-driving partial frame period NDPFP. For example, the power block 690 may change at least one of a high gate voltage VGH or a low gate voltage VGL to an off level not only in the non-driving frame period NDFP but also in the non-driving partial frame period NDPFP. Thus, a scan start signal FLM and a scan clock signal SCLK also may have the off level of about 0V in the non-driving frame period NDFP and the non-driving partial frame period NDPFP. Accordingly, the scan driver 630 may not generate 1st through 2000th scan signals SS1 through SS2000 in the non-driving frame period NDFP, may generate the 1st through 1000th scan signals SS1 through SS1000 in a partial period of the third frame period FP3, and may not generate the 1001st through 2000th scan signals SS1001 through SS2000 in the remaining period of the third frame period FP3, or in the non-driving partial frame period NDPFP. Accordingly, the power consumption of the scan driver 630 may be further reduced, and the power consumption of the display device 600 may be further reduced.

Figure 24:
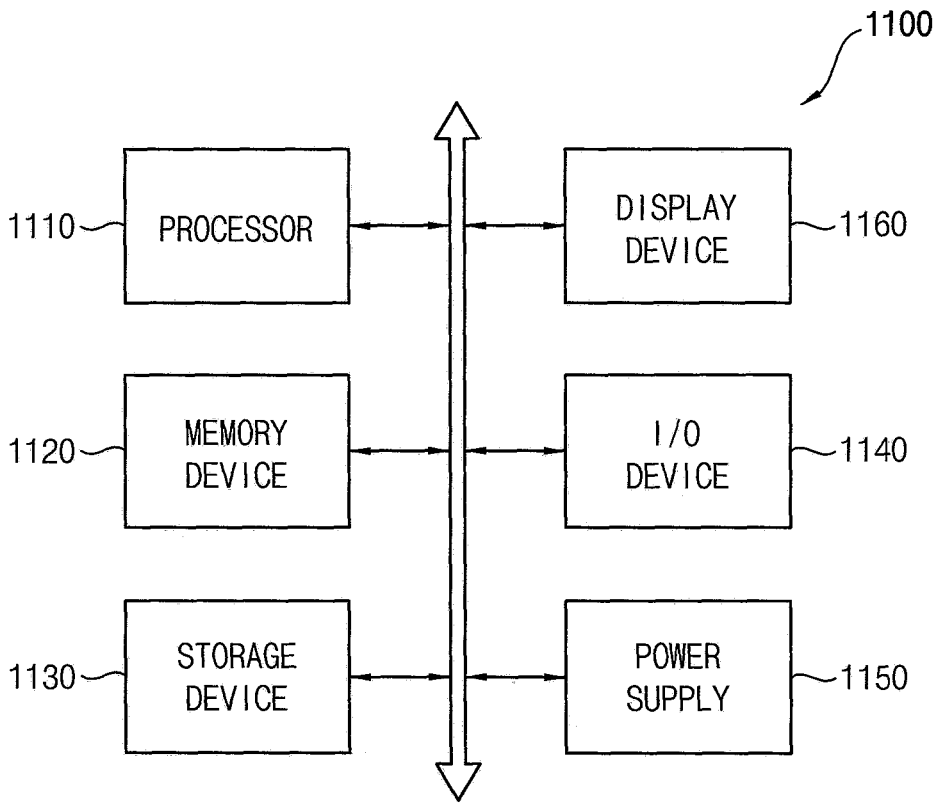
FIG. 24 is an electronic device including a display device according to some example embodiments.

FIG. 24 is an electronic device including a display device according to some example embodiments.

Referring to FIG. 24, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

The display device 1160 may perform multi-frequency driving (MFD) that drives a plurality of partial panel zones at a plurality of different driving frequencies. Accordingly, the power consumption of the display device 1160 may be reduced. Further, the display device 1160 may set a non-driving frame period based on the maximum driving frequency of the plurality of driving frequencies for the plurality of partial panel zones, and may not provide a scan driver input signal to a scan driver in the non-driving frame period. Accordingly, the power consumption of the scan driver may be reduced in the non-driving frame period, and the power consumption of the display device 1160 may be further reduced.

The inventive concepts may be applied to any display device 1160, and any electronic device 1100 including the display device 1160. For example, the inventive concepts may be applied to a mobile phone, a smart phone, a wearable electronic device, a tablet computer, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the example embodiments of the present invention.

The foregoing is illustrative of example embodiments and is not to be construed as limiting thereof. Although a few example embodiments have been described, those skilled in the art will readily appreciate that many modifications are possible in the example embodiments without materially departing from the novel teachings and characteristics of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A display device comprising:

a display panel including a plurality of pixels;

a data driver configured to provide data signals to the plurality of pixels;

a scan driver configured to provide scan signals to the plurality of pixels based on a scan driver input signal including a scan start signal and a scan clock signal; and a controller configured to control the data driver and the scan driver, the controller including:

a zone splitting block configured to divide input image data into a plurality of partial image data respectively corresponding to a plurality of partial panel zones of the display panel;

a plurality of panel zone frequency deciding blocks configured to determine a plurality of driving frequencies for the plurality of partial panel zones by analyzing the plurality of partial image data, respectively;

a non-driving period setting block configured to classify a plurality of frame periods into a driving frame period and a non-driving frame period based on a maximum driving frequency of the plurality of driving frequencies; and a scan driver control block configured to provide the scan driver input signal to the scan driver in the driving frame period, and to not provide the scan start signal and the scan clock signal to the scan driver in the non-driving frame period.

2. The display device of claim 1, wherein the controller further includes a power block configured to generate a high gate voltage and a low gate voltage, wherein the scan driver control block includes:

a scan driver input signal generating unit configured to generate an initial scan start signal and an initial scan clock signal; and a level shifting unit configured to generate, as the scan driver input signal, the scan start signal and the scan clock signal by changing voltage levels of the initial scan start signal and the initial scan clock signal based on at least one of the high gate voltage and the low gate voltage, and wherein, in the non-driving frame period, the power block is configured to change the at least one of the high gate voltage and the low gate voltage to an off level.

3. The display device of claim 1, wherein the scan driver control block is configured to provide a scan output masking signal to the scan driver in a partial period of the driving frame period assigned to a portion of the plurality of partial panel zones such that the scan signals are not provided to the portion of the plurality of partial panel zones within the driving frame period.

4. The display device of claim 3, wherein the scan driver includes:

a plurality of stages configured to generate the scan signals for a plurality of scan lines included in the display panel; and a plurality of logic gates respectively connected to the plurality of stages, and configured to selectively output the scan signals generated by the plurality of stages in response to the scan output masking signal, respectively.

5. The display device of claim 1, wherein the display device is a foldable display device, wherein the plurality of partial panel zones include a first partial panel zone located in a first direction from a folding line of the foldable display device, and a second partial panel zone located in a second direction opposite to the first direction from the folding line, and wherein the zone splitting block is configured to divide the input image data into, as the plurality of partial image data, first partial image data for the first partial panel zone and second partial image data for the second partial panel zone.

6. The display device of claim 1, wherein each of the plurality of panel zone frequency deciding blocks includes:

a still image detecting unit configured to receive corresponding partial image data of the plurality of partial image data at an input frame frequency, and to determine whether the corresponding partial image data represent a still image; and a driving frequency deciding unit configured to determine a corresponding driving frequency of the plurality of driving frequencies as the input frame frequency when the corresponding partial image data do not represent the still image, and to determine the corresponding driving frequency as a frequency lower than the input frame frequency when the corresponding partial image data represent the still image.

7. The display device of claim 6, wherein each of the plurality of panel zone frequency deciding blocks further includes:

a representative value memory configured to store a representative value of the corresponding partial image data in a previous frame period, and wherein the still image detecting unit is configured to calculate a representative value of the corresponding partial image data in a current frame period, and to determine whether or not the corresponding partial image data represents the still image by comparing the calculated representative value of the corresponding partial image data with the representative value of the corresponding partial image data stored in the representative value memory.

8. The display device of claim 6, wherein each of the plurality of panel zone frequency deciding blocks further includes:

a flicker lookup table configured to store flicker values corresponding to respective image data gray levels, and wherein the driving frequency deciding unit is configured to determine, based on the corresponding partial image data representing the still image, a flicker value corresponding to a gray level of the corresponding partial image data by using the flicker lookup table, and to determine the corresponding driving frequency according to the determined flicker value.

9. The display device of claim 6, wherein each of the plurality of panel zone frequency deciding blocks further includes:

a driving frequency mixing unit configured to gradually change a corresponding one of the plurality of driving frequencies for a corresponding partial panel zone of the plurality of partial panel zones from a previous driving frequency for the partial panel zone to the corresponding driving frequency determined by the driving frequency deciding unit when the corresponding driving frequency determined by the driving frequency deciding unit is changed from the previous driving frequency.

10. The display device of claim 1, wherein each of the plurality of pixels includes:

a driving transistor configured to generate a driving current;

a switching transistor configured to transfer a corresponding one of the data signals to a source of the driving transistor;

a compensating transistor configured to diode-connect the driving transistor;

a storage capacitor configured to store the corresponding one of the data signals transferred through the switching transistor and the diode-connected driving transistor;

a first initializing transistor configured to provide an initialization voltage to the storage capacitor and a gate of the driving transistor;

a first emission controlling transistor configured to connect a line of a power supply voltage to the source of the driving transistor;

a second emission controlling transistor configured to connect a drain of the driving transistor to an organic light emitting diode;

a second initializing transistor configured to provide the initialization voltage to the organic light emitting diode; and the organic light emitting diode configured to emit light based on the driving current, wherein at least a first one of the driving transistor, the switching transistor, the compensating transistor, the first initializing transistor, the first emission controlling transistor, the second emission controlling transistor, or the second initializing transistor is implemented with a PMOS transistor, and at least a second one of the driving transistor, the switching transistor, the compensating transistor, the first initializing transistor, the first emission controlling transistor, the second emission controlling transistor, or the second initializing transistor is implemented with an NMOS transistor.

11. The display device of claim 1, wherein the non-driving period setting block is configured to set a partial period of the driving frame period as a non-driving partial frame period based on a driving frequency lower than the maximum driving frequency among the plurality of driving frequencies, and wherein the scan driver control block is configured to not provide the scan driver input signal to the scan driver in the non-driving frame period and the non-driving partial frame period.

12. The display device of claim 11, wherein the controller further includes a power block configured to generate a high gate voltage and a low gate voltage, wherein the scan driver control block includes:

a scan driver input signal generating unit configured to generate an initial scan start signal and an initial scan clock signal; and a level shifting unit configured to generate, as the scan driver input signal, the scan start signal and the scan clock signal by changing voltage levels of the initial scan start signal and the initial scan clock signal based on at least one of the high gate voltage and the low gate voltage, and wherein the power block is configured to, in the non-driving frame period and the non-driving partial frame period, change the at least one of the high gate voltage and the low gate voltage to an off level.

13. A display device comprising:

a display panel including a plurality of pixels;

a data driver configured to provide data signals to the plurality of pixels;

a scan driver configured to provide scan signals to the plurality of pixels based on a scan driver input signal including a scan start signal and a scan clock signal; and a controller configured to control the data driver and the scan driver, the controller including:

a zone splitting and still image detecting block configured to receive input image data at an input frame frequency, and configured to divide the input image data into moving image partial data representing a moving image and still image partial data representing a still image;

a zone splitting and panel zone frequency deciding block configured to determine a first driving frequency for a first partial panel zone of the display panel corresponding to the moving image partial data as the input frame frequency, and to determine a plurality of second driving frequencies for a plurality of second partial panel zones of the display panel by analyzing the still image partial data;

a non-driving period setting block configured to classify a plurality of frame periods into a driving frame period and a non-driving frame period based on a maximum driving frequency of the first driving frequency and the plurality of second driving frequencies; and a scan driver control block configured to provide the scan driver input signal to the scan driver in the driving frame period, and to not provide the scan start signal and the scan clock signal to the scan driver in the non-driving frame period.

14. The display device of claim 13, wherein the controller further includes a power block configured to generate a high gate voltage and a low gate voltage, wherein the scan driver control block includes:

a scan driver input signal generating unit configured to generate an initial scan start signal and an initial scan clock signal; and a level shifting unit configured to generate, as the scan driver input signal, the scan start signal and the scan clock signal by changing voltage levels of the initial scan start signal and the initial scan clock signal based on at least one of the high gate voltage and the low gate voltage, and wherein the power block is configured to, in the non-driving frame period, change the at least one of the high gate voltage and the low gate voltage to an off level.

15. The display device of claim 13, wherein the zone splitting and still image detecting block includes:

a plurality of representative value memories configured to store a plurality of representative values of a plurality of input partial image data in a previous frame period; and a zone still image detecting unit configured to:

receive the input image data in a current frame period;

divide the input image data in the current frame period into the plurality of input partial image data;

calculate a plurality of representative values of the plurality of input partial image data in the current frame period;

determine whether each of the plurality of input partial image data represent the moving image or the still image by comparing the plurality of representative values with the plurality of representative values stored in the plurality of representative value memories;

output input partial image data representing the moving image among the plurality of input partial image data as the moving image partial data; and output input partial image data representing the still image among the plurality of input partial image data as the still image partial data.

16. The display device of claim 13, wherein the zone splitting and panel zone frequency deciding block includes:

a flicker lookup table configured to store flicker values corresponding to respective image data gray levels; and a zone driving frequency deciding unit configured to:

determine the first driving frequency for the first partial panel zone corresponding to the moving image partial data as the input frame frequency;

divide the still image partial data into a plurality of segment data for a plurality of segments;

determine a plurality of segment flicker values corresponding to gray levels of the plurality of segment data by using the flicker lookup table;

determine the plurality of second partial panel zones by grouping the plurality of segments based on a plurality of segment driving frequencies corresponding to the plurality of segment flicker values; and respectively determine the plurality of second driving frequencies for the plurality of second partial panel zones based on the plurality of segment driving frequencies of the plurality of second partial panel zones.

17. The display device of claim 13, wherein the non-driving period setting block sets a partial period of the driving frame period as a non-driving partial frame period based on a driving frequency lower than the maximum driving frequency among the first driving frequency and the plurality of second driving frequencies, and wherein the scan driver control block does not provide the scan driver input signal to the scan driver in the non-driving frame period and the non-driving partial frame period.

18. The display device of claim 17, wherein the controller further includes a power block configured to generate a high gate voltage and a low gate voltage, wherein the scan driver control block includes:

a scan driver input signal generating unit configured to generate an initial scan start signal and an initial scan clock signal; and a level shifting unit configured to generate, as the scan driver input signal, the scan start signal and the scan clock signal by changing voltage levels of the initial scan start signal and the initial scan clock signal based on at least one of the high gate voltage and the low gate voltage, and wherein the power block is configured to, in the non-driving frame period and the non-driving partial frame period, change the at least one of the high gate voltage and the low gate voltage to an off level.

* * * * *